US012805694B2

(12) United States Patent
Nam et al.

(10) Patent No.: US 12,805,694 B2
(45) Date of Patent: Nov. 24, 2026

(54) SHOE CARE APPARATUS

(71) Applicant: LG ELECTRONICS INC., Seoul (KR)

(72) Inventors: Bo Hyun Nam, Seoul (KR); Jae Young Kim, Seoul (KR); Seung Hyun Song, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 332 days.

(21) Appl. No.: 18/721,039

(22) PCT Filed: Dec. 2, 2022

(86) PCT No.: PCT/KR2022/019493
§ 371 (c)(1),
(2) Date: Jun. 17, 2024

(87) PCT Pub. No.: WO2023/113326
PCT Pub. Date: Jun. 22, 2023

(65) Prior Publication Data

US 2025/0057391 A1 Feb. 20, 2025

(30) Foreign Application Priority Data

Dec. 17, 2021 (KR) ..... 10-2021-0181769

(51) Int. Cl.
*A47L 23/20* (2006.01)
*A47B 61/04* (2006.01)

(52) U.S. Cl.
CPC ..... *A47L 23/205* (2013.01); *A47B 61/04* (2013.01)

(58) Field of Classification Search
CPC ..... A47L 23/205; A47L 23/02; A47L 23/18; A47L 23/20; A47L 2601/04; A61L 2/04; A47B 61/04
See application file for complete search history.

(56) References Cited

U.S. PATENT DOCUMENTS

2021/0220496 A1* 7/2021 An ..... A47L 23/205
2021/0401262 A1* 12/2021 Yoo ..... A47L 23/02

FOREIGN PATENT DOCUMENTS

| | | | |
|---|---|---|---|
| CN | 112956989 | A | 6/2021 |
| JP | 2006-223889 | A | 8/2006 |
| KR | 10-2000-0009653 | A | 2/2000 |
| KR | 10-1037245 | B1 | 5/2011 |

(Continued)

*Primary Examiner* — William C Doerrler
(74) *Attorney, Agent, or Firm* — Birch, Stewart, Kolasch & Birch, LLP

(57) ABSTRACT

A shoe care apparatus includes an inner cabinet, a door, a nozzle duct, a nozzle, and a nozzle handle. The inner cabinet forms an accommodation space in which shoes are accommodated. The inner cabinet has a main opening. The door opens and closes the main opening. The nozzle duct is hinge-coupled to the inner cabinet. The nozzle duct forms a passage for air that is being forcibly blown. The nozzle is coupled to an end portion of the nozzle duct. The nozzle handle is formed on the nozzle so as to adjust the angle of the nozzle duct. The inner cabinet includes an inner upper plate that constitutes the ceiling of the accommodation space. The inner upper plate includes a first region and a second region. The second region extends from in front of the first region. The second region forms an upwardly inclined surface.

20 Claims, 21 Drawing Sheets

(56) References Cited

FOREIGN PATENT DOCUMENTS

| | | | | | |
|---|---|---|---|---|---|
| KR | 10-2014-0035465 | A | | 3/2014 | |
| KR | 10-2021-0030856 | A | | 3/2021 | |
| KR | 10-2021-0085188 | A | | 7/2021 | |
| KR | 10-2021-0093105 | A | | 7/2021 | |
| KR | 20210158774 | A | * | 12/2021 | ..... A47B 61/04 |
| KR | 20230026120 | A | * | 2/2023 | ..... F26B 3/06 |
| WO | WO 2021/137389 | A1 | | 7/2021 | |
| WO | WO 2021/206240 | A1 | | 10/2021 | |

* cited by examiner

SHOE CARE APPARATUS

CROSS-REFERENCE TO RELATED APPLICATIONS

This application is the National Phase of PCT International Application No. PCT/KR2022/019493 filed on Dec. 2, 2022, which claims priority under 35 U.S.C. § 119 (a) to Patent Application No. 10-2021-0181769, filed in the Republic of Korea on Dec. 17, 2021, all of which are hereby expressly incorporated by reference into the present application.

TECHNICAL FIELD

The present invention relates to a shoes care device (shoe care apparatus), and more particularly, to a shoes care device which treats shoes by air circulation.

BACKGROUND

Shoes may get wet by a wearer's sweat, external contaminants, or rain or snow. Wearing such shoes may make the wearer uncomfortable, and in this condition, germs may also breed or the shoes may stink.

Accordingly, there is an increasing interest in a shoes care device, which removes germs and odors by performing a predetermined treatment on the shoes so that a user can comfortably wear the shoes all the time.

For the shoes care device, Korean Patent No. 10-1037245 (hereinafter, referred to as "Prior Art Document 1"), entitled, "Apparatus for sterilization disposal of shoes", includes a main body, an ultraviolet emission module, and a deodorization module.

According to Prior Art Document 1 above, the shoes are disposed in a sterilization chamber of the main body, and the ultraviolet emission module is driven to remove germs and odors of the shoes. Furthermore, the air in the sterilization chamber is sucked into a ventilation pipe and discharged to the outside of the main body through an exhaust port through the deodorization module.

Here, the deodorization module includes a deodorization column made up of materials such as zeolite, activated carbon, and charcoal, and removes contaminants from the air discharged from the inside of the main body to the outside by the deodorization column.

According to Prior Art Document 1 above, the air from which moisture has been removed by a deodorization module including zeolite and activated carbon can be discharged to the outside of the apparatus for sterilization of shoes.

However, in Prior Art Document 1 above, since the air is discharged to the outside of the apparatus for sterilization of shoes, the air that has not sufficiently removed moisture or odors may be discharged to the outside of the apparatus for sterilization of shoes, and such air may be discharged to the inside where the wearer resides.

In addition, Korean Patent Unexamined Publication No. 10-2000-0009653 (hereinafter referred to as "Prior Art Document 2"), entitled, "The shoes cabinet for sanitation", discloses a shoe closet that includes a main body, a far infrared radiation part, a circulation fan, an air circulation passage, and a sanitary filter portion.

According to Prior Art Document 2 above, while storing shoes in the shoe closet, hygiene treatments such as dehumidification, sterilization, and deodorization can be performed on the shoes by far-infrared rays and a filter during the storing of the shoes.

Here, since the sanitary filter portion is filled with excellent adsorptive materials such as charcoal, it can serve to adsorb moisture in the process of ventilating air and filter bacteria, as well as to capture malodorous substances.

According to Prior Art Document 2 above, the air is circulated by a circulating fan in a shoe closet, and the sanitary filter portion is disposed on a circulation path of the air to remove germs and odors in the air.

However, since Prior Art Document 2 above does not consider a technology to prevent the reduction of the performance of the sanitary filter portion configured to remove moisture or odors, a user may not be satisfied because the shoes are not properly treated at the time of using a shoes care device.

As described above, for the shoes care device that removes germs or odors by treating the shoes in a predetermined manner, a task that has to be solved to ensure proper performance for shoes treatment while preventing the air used for dehumidification and deodorization from being exposed to the user is present in in the process of treating the shoes.

However, there is a limitation in that the conventional shoes care device cannot properly solve such a task.

In addition, when designing and manufacturing devices including a dehumidifier such as zeolite, it is necessary to consider how the dehumidification efficiency of a dehumidifying material can be further improved, whether the dehumidifying material can be effectively regenerated, whether water vapor generated during the use of the shoes care device and the regeneration of the dehumidifying material can be effectively removed or managed, whether moisture is left in an unintended area during use of the shoes care device and the regeneration of the dehumidifying, whether components are properly disposed in a limited space, and whether the devices provides excellent use convenience. There is a need to develop a shoes care device that takes these matters into consideration.

In addition, the reduction of manufacturing costs, the convenience of manufacturing and assembling each component, and the convenience of maintenance needs to be considered in the development of the shoes care device.

In addition, when developing a shoe care apparatus, it is necessary to consider whether there is a good view of the components to be operated by the user in the space that accommodates shoes, whether the operability and mobility of the components operated by the user are good, and whether there is any possibility of contamination of shoes due to moisture.

DISCLOSURE

Technical Problem

The present disclosure is to provide a shoe care apparatus in which, even when the user's eye level is higher than the accommodation space where the shoes are accommodated, a sufficient view of the receiving space can be secured, and a view of components to be operated by the user within the accommodation can be secured.

In addition, the present invention is to provide a shoe care apparatus in which the operability and mobility of the components to be operated by the user within the accommodation space can be improved.

Furthermore, the present disclosure is to provide a shoe care apparatus in which, even if moisture is generated on the ceiling of the accommodation space due to condensation, the possibility of contamination of shoes due to moisture can be eliminated, and moisture generated on the ceiling of the accommodation space can be prevented from moving to the inner surface of a door.

Technical Solution

A shoe care apparatus disclosed herein may include an inner cabinet, a door, a nozzle duct, a nozzle, a nozzle handle, and a nozzle connector.

The inner cabinet may define an accommodation space therein. The inner cabinet may have a main opening that opens the accommodation space in a first direction which is a horizontal direction.

The inner cabinet may include an inner rear plate and an inner upper plate.

The inner rear plate may constitute a wall surface behind the accommodation space. The inner rear plate may define a plane orthogonal to the first horizontal direction.

The inner upper plate may define the ceiling of the accommodation space. The inner upper plate may include a first region and a second region. The first region and the second region may be integrated with each other.

The inner cabinet may include a front frame. The front frame may extend in front of the inner upper plate with reference to the first direction. The front frame may define the edge of the main opening. The front surface of the front frame may be orthogonal to the first direction.

The shoe care apparatus according to an embodiment of the present disclosure may include a management device. The management device may include an inner cabinet and a drying module. The shoe care apparatus may include a first management device and a second management device.

The first management device and the second management device may be provided adjacent to each other. The first management device may be located above the second management device. The front frames of the inner cabinet of the first management device and the inner cabinet of the second management device may be connected to each other.

The first region may refer to a region extending in an upwardly inclined direction from the upper side of the inner rear plate. The height of the first region may increase toward the first direction.

The first region of the first management device may form an angle of $\theta 1$ with a horizontal plane.

The first region of the second management device may form an angle of $\delta 1$ with the horizontal plane.

The second region may define a region extending in front of the first region with reference to the first direction. The second region may form an upwardly inclined surface.

With reference to the first direction, the second region of the first management device may form an angle of $\theta 2$ with the horizontal plane.

The first region may be inclined upward along the first direction to a smaller angle than the inclination angle formed by the second region. $\theta 2$ may be an angle greater than $\theta 1$.

With reference to the first direction, the second region of the second management device may form an angle of $\delta 2$ with the horizontal plane.

The first region may be inclined upward along the first direction to a smaller angle than the inclination angle formed by the second region. $\delta 2$ may be an angle greater than $\delta 1$.

With reference to the first direction, the second region of the second management device may have a larger inclination angle with the horizontal plane than the second region of the first management device. Therefore, even if a user slightly bends his or her knees or waist to look at the accommodation space of the second management device, the height difference between the user's gaze and the accommodation space may be greater than the difference in height between the user's gaze and the accommodation space of the first management device when the user's gaze looks at the accommodation space of the first management device.

A nozzle duct may provide a passage for forcefully blown air. The nozzle duct may be installed to protrude forward from the inner rear plate.

One end of the nozzle duct may be hinged to the inner rear plate. One end of the nozzle duct may be hinged to the inner rear plate via the nozzle duct hinge shaft.

A nozzle may be coupled to the other end of the nozzle duct.

The nozzle may be hinged to the other end of the nozzle duet.

The nozzle may include a nozzle body and a nozzle protrusion.

The nozzle body may be hinged to the nozzle duct. The nozzle body may be coupled to the nozzle hinge shaft provided at the other end of the nozzle duct. Therefore, the nozzle is rotatable around the nozzle hinge shaft.

The nozzle protrusion may protrude downward from the nozzle body. A lower discharge port may be provided at the lower end of the nozzle protrusion. The nozzle may spray air downward through the lower discharge port while the lower portion of the nozzle protrusion is inserted into shoes.

A nozzle handle may be provided on the nozzle body. The nozzle handle may protrude in a first direction from the front surface of the nozzle body in the first direction. The user may adjust the angle of the nozzle duct by holding the nozzle handle and applying force to the same.

One end of the nozzle connector may be hinged to the inner rear plate. A first connection hinge shaft may be provided at one end of the nozzle connector. The first connection hinge shaft may be rotatably coupled to the inner rear plate. Therefore, the nozzle connector is rotatable around the first connection hinge shaft.

The other end of the nozzle connector may be hinged to the nozzle. A second connection hinge shaft may be provided at the other end of the nozzle connector. The second connection hinge shaft may be rotatably coupled to the nozzle body. Therefore, the nozzle connector is rotatable around the second connection hinge shaft.

The nozzle duct hinge shaft and the first connection hinge shaft may be rotatably coupled to the inner rear plate. The nozzle hinge shaft and the second connection hinge shaft may be rotatably coupled to the nozzle body.

Therefore, even if the nozzle duct rotates with respect to the inner cabinet, the nozzle body is able to maintain its angle. Therefore, even if the nozzle duct rotates with respect to the inner cabinet, the nozzle is able to spray air in a constant direction, that is, downward. In addition, even if the nozzle duct rotates with respect to the inner cabinet, the nozzle handle is able to maintain a constant angle.

With reference to the state in which the upper surface of the nozzle body portion is brought into contact with the lower surface of the inner upper plate by adjusting the angle of the nozzle duct, the first region and the nozzle is able to form an attractive force by magnetic force.

One of the first region and the nozzle body may include a first magnetic body. The other one of the first region and the nozzle body may include a second magnetic body. The first magnetic body and the second magnetic body may form an attractive force due to magnetic force.

Even if the nozzle duct rotates with respect to the inner cabinet, the nozzle handle maintains the constant angle, so that whenever the upper surface of the nozzle body is brought into contact with the lower surface of the inner upper plate, the first magnetic body and the second magnetic body always exert a constant attractive force.

The upper surface of the nozzle body may be formed to correspond to the lower surface of the first region. Therefore, in the state in which the upper surface of the nozzle body is brought into contact with the lower surface of the inner upper plate, the upper surface of the nozzle body and the lower surface of the inner upper plate can be in close contact with each other.

With reference to the state in which the upper surface of the nozzle is in contact with the lower surface of the inner upper plate, the nozzle may be disposed at the lower portion of the first region, and the nozzle handle may be disposed at the lower portion of the second region. Accordingly, at least a portion of the nozzle handle may be located in front of the first direction with reference to a virtual plane extending from the inclined surface of the second region.

The virtual plane extending from the inclined surface of the second region may be located above the shoes. Therefore, with reference to the state in which the nozzle handle is moved by adjusting the angle of the nozzle duct, at least part or all of the nozzle handle may move in front of the first direction with reference to the virtual plane extending from the inclined surface of the second region.

Moisture condensed in the second region may move toward the boundary of the first region along the inclined surface of the second region. The moisture moved toward the boundary of the first region may move toward the inner rear plate along the inclined surface of the first region.

Advantageous Effect

In the shoe care apparatus according to an embodiment of the present disclosure, the second region extends in front of the first region with reference to the first direction and defines an upwardly inclined surface, and at least a portion of the nozzle handle is located in front of the first direction with reference to a virtual plane extending from the inclined surface of the second region. As a result, the user's viewing angle looking at the accommodation space can be increased, and at least a portion of the nozzle handle can be exposed to the user's viewing angle.

In the shoe care apparatus according to an embodiment of the present disclosure, with reference to the first direction, the inclination angle of the second region of the second management device relative to the horizontal plane is larger than that of the second region of the first management device. Thus, even if the height difference between the user's gaze and the accommodation space of the second management device is greater than the height difference between the user's gaze and the accommodation space of the first management device, the user's viewing angle looking at the accommodation space can be sufficiently increased.

In the shoe care apparatus according to an embodiment of the present disclosure, the nozzle duct hinge shaft and the first connection hinge shaft may be rotatably coupled to the inner rear plate, and the nozzle hinge shaft and the second connection hinge shaft may be rotatably coupled to the nozzle body. Therefore, even if the nozzle duct rotates with respect to the inner cabinet, the nozzle body maintains an angle. Thus, the nozzle handle is able to maintain a constant angle even if the nozzle duct rotates, thereby improving the operability of the nozzle handle.

In the shoe care apparatus according to an embodiment of the present disclosure, one of the first region and the nozzle body includes a first magnetic body, the other one of the first region and the nozzle body includes a second magnetic body, and the first magnetic body and the second magnetic body is able to form an attractive force to each other by magnetic force. Therefore, the upper surface of the nozzle body can be maintained in contact with the lower surface of the inner upper plate.

In the shoe care apparatus according to an embodiment of the present disclosure, the upper surface of the nozzle body is formed to correspond to the lower surface of the first region, so that the upper surface of the nozzle body can be close contact with each other in the state in which the upper surface of the nozzle body is in contact with the lower surface of the inner upper plate. Therefore, when the shoes are not processed, it is possible to suppress the movement of the nozzle body due to external shock and gravity, as well as the resulting failure and noise occurrence.

In the shoe care apparatus according to the present disclosure, with reference to the state in which the upper surface of the nozzle is in contact with the lower surface of the inner upper plate, the nozzle may be disposed at the lower portion of the first region, and the nozzle handle may be disposed at the lower portion of the second region. Therefore, when the user's gaze matches a first virtual plane and a second virtual plane or is lower than the virtual planes, part or all of the nozzle handle is exposed to the user's viewing angle. Thus, the user is able to immediately check the position of the nozzle handle, hold the nozzle handle, and rotate the nozzle duct.

In the shoe care apparatus according to an embodiment of the present disclosure, moisture condensed in the second region moves toward the boundary of the first region along the inclined surface of the second region, and the moisture moved toward the boundary of the first region moves toward the inner rear plate along the inclined surface of the first region. As a result, the amount of moisture condensed on the rear plate can be suppressed, and contamination of the shoes due to condensation can be prevented.

BRIEF DESCRIPTION OF THE DRAWINGS

FIG. 3 illustrates shoes accommodated in an inner cabinet together.

FIGS. 4*a* to 4*c* illustrate a form where a door is included in the shoes care device, and do not illustrate shoes.

FIG. 8*a* illustrates a state in which the door is included in the shoes care device, and does not illustrate the shoes.

FIG. 9 illustrates a state in which the door is included in the shoes care device.

FIG. 12 illustrates the shoes accommodated in the inner cabinet together.

FIG. 13 illustrates the shoes accommodated in the inner cabinet together.

FIG. 16 illustrates the inside of the inner cabinet of the second management device.

DETAILED DESCRIPTION

Figure 1A:
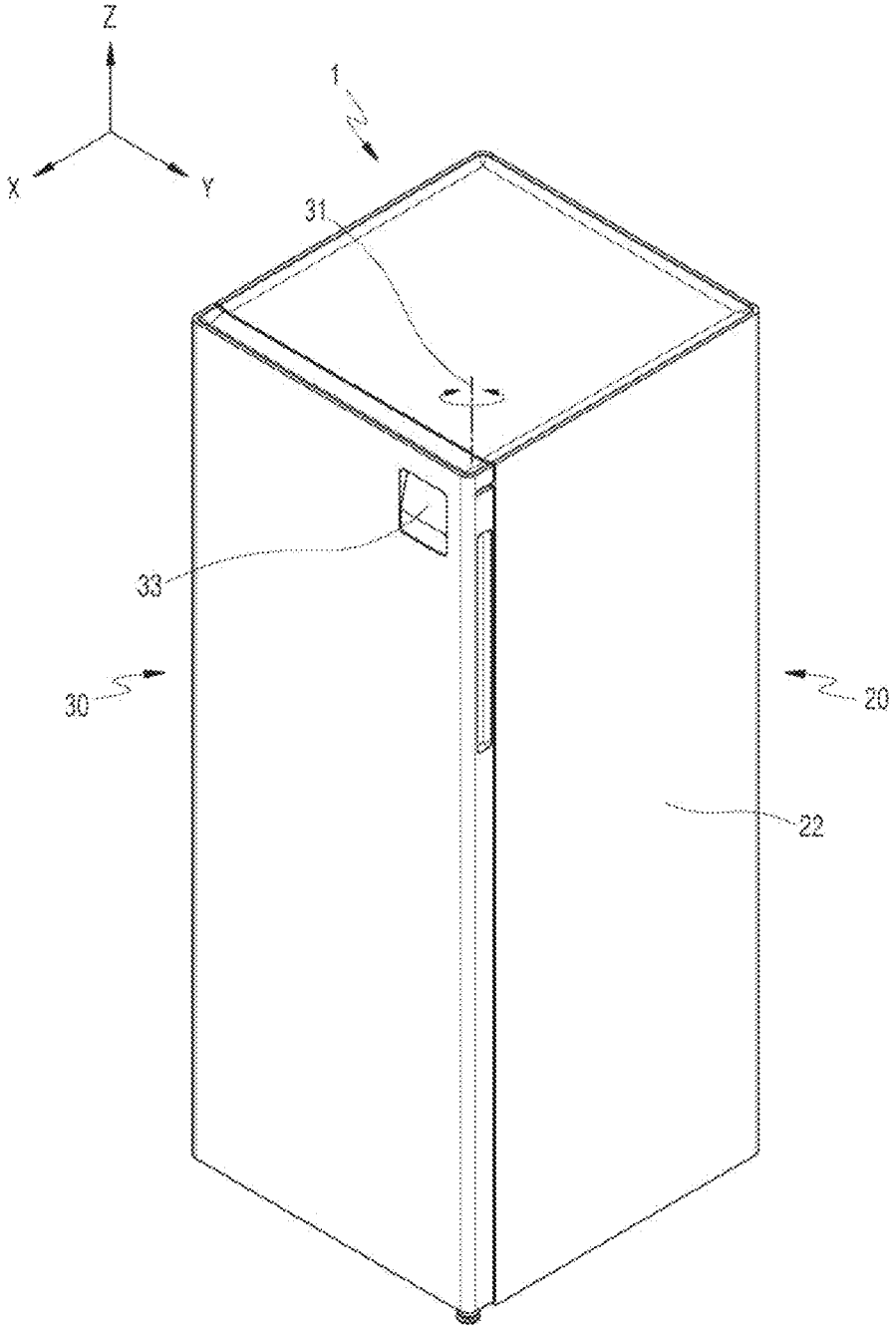
FIG. 1*a* is a perspective view illustrating a shoes care device according to one embodiment of the present invention.

Hereinafter, exemplary embodiments disclosed herein will be described in detail with reference to the accompanying drawings, and like reference numerals designate like elements, and redundant description thereof will be omitted. Suffixes "module" and "unit or portion" for elements used in the following description are merely provided for facilitation of preparing this specification, and thus they are not granted a specific meaning or function. Wherever possible, the same reference numbers will be used throughout the drawings to refer to the same or like parts. In the following description, known functions or structures, which may confuse the substance of the present disclosure, are not explained. The accompanying drawings are used to help easily explain various technical features and it should be understood that the exemplary embodiments presented herein are not limited by the accompanying drawings. As such, the present disclosure should be construed to extend to any alterations, equivalents and substitutes in addition to those which are particularly set out in the accompanying drawings.

Although the terms first, second, and the like, may be used herein to describe various elements, these elements should not be limited by these terms. These terms are generally only used to distinguish one element from another.

When an element or layer is referred to as being "on," "engaged to," "connected to," or "coupled to" another element or layer, it may be directly on, engaged, connected, or coupled to the other element or layer, or intervening elements or layers may be present. In contrast, when an element is referred to as being "directly on," "directly engaged to," "directly connected to," or "directly coupled to" another element or layer, there may be no intervening elements or layers present.

The singular expressions include plural expressions unless the context clearly dictates otherwise.

It should be understood that the terms "comprises," "comprising," "includes," "including," "containing," "has," "having" or any other variation thereof specify the presence of stated features, integers, steps, operations, elements, and/or components, but do not preclude the presence or addition of one or more other features, integers, steps, operations, elements, and/or components.

A first direction (X direction), a second direction (Y direction), and a third direction (Z direction) described in one embodiment of the present invention may be directions orthogonal to each other.

Each of the first direction (X direction) and the second direction (Y direction) may be a direction parallel to the horizontal direction, and the third direction (Z direction) may be a direction parallel to the vertical direction. When the first direction (X direction) is parallel to a left-right direction, the second direction (Y direction) may be parallel to a front-rear direction. When the first direction (X direction) is parallel to the front-rear direction, the second direction (Y direction) may be parallel to the left-right direction.

FIG. 1*a* is a perspective view illustrating a shoes care device according to one embodiment of the present invention.

Figure 1B:
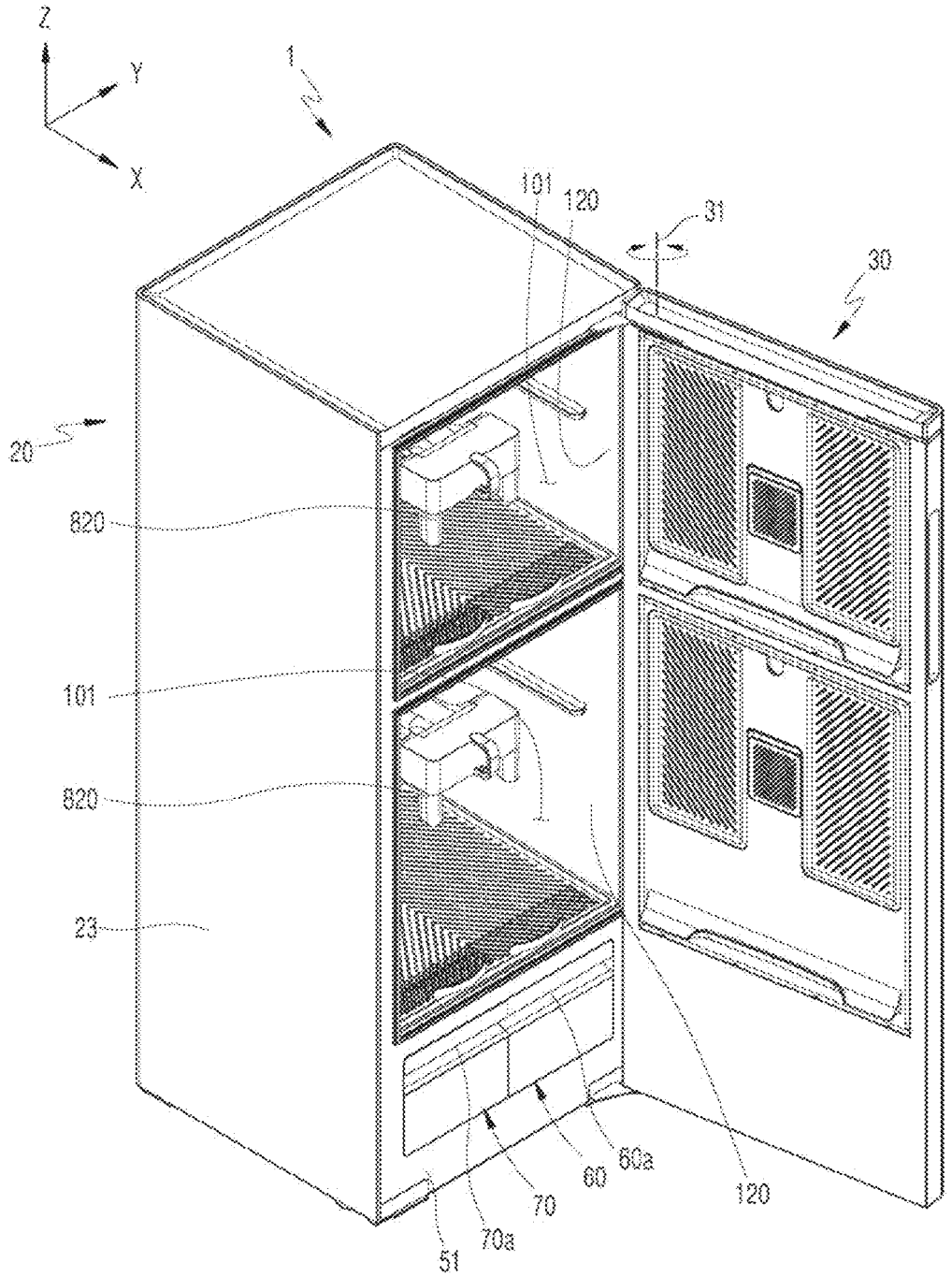
FIG. 1*b* is a perspective view of the shoes care device of FIG. 1*a*, when viewed from another direction, illustrating a state in which a door is opened.

FIG. 1*b* is a perspective view of the shoes care device of FIG. 1*a*, when viewed from another direction, illustrating a state in which a door is opened.

Figure 2A:
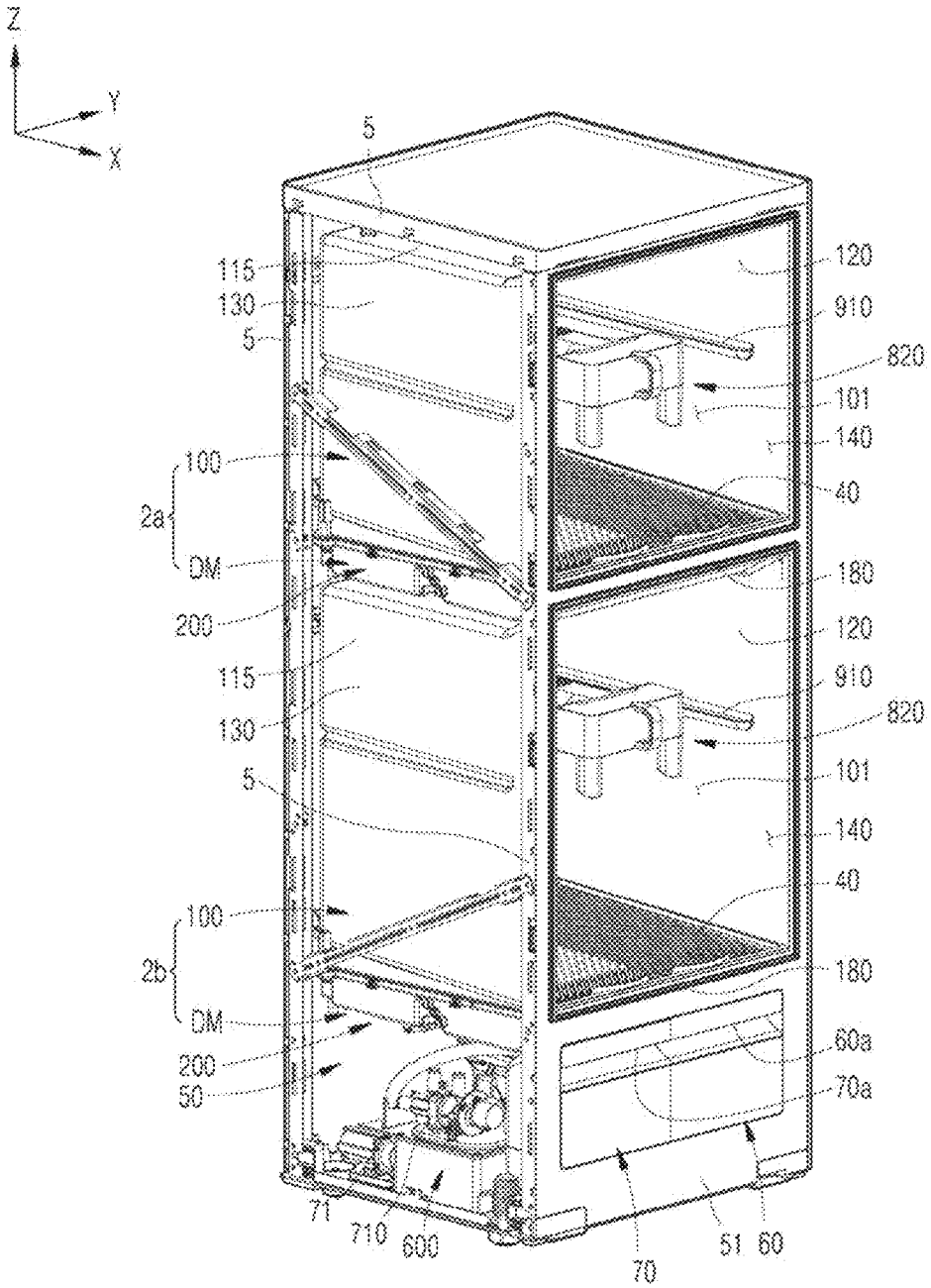
FIG. 2*a* is a perspective view illustrating a state in which a part of the door and an outer cabinet are removed from the shoes care device of FIG. 1*b*.

FIG. 2*a* is a perspective view illustrating a state in which a part of the door and an outer cabinet are removed from the shoes care device of FIG. 1B.

Figure 2B:
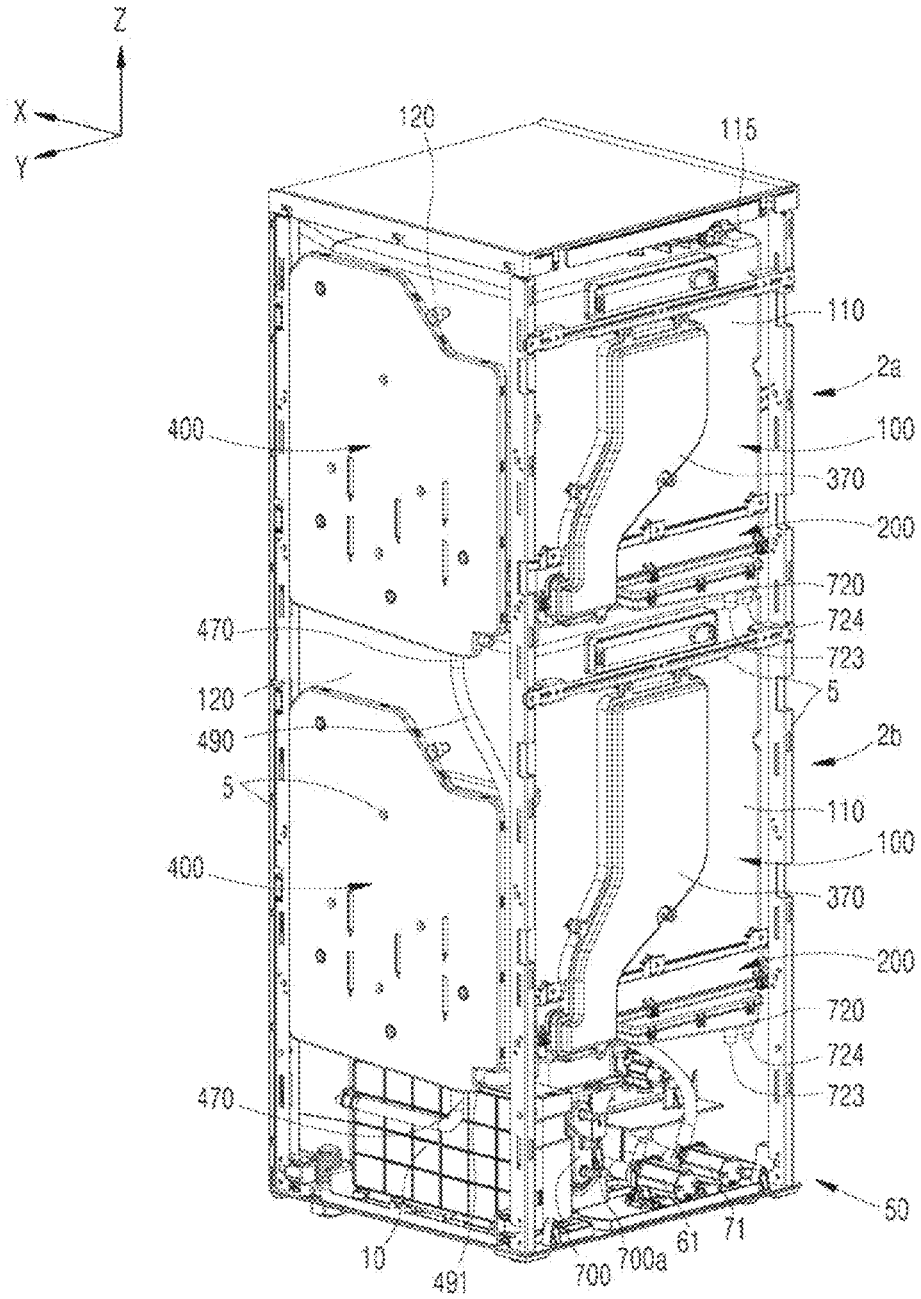
FIG. 2*b* is a perspective view illustrating a state in which the shoes care device illustrated in FIG. 2*a* is viewed from another direction.

FIG. 2*b* is a perspective view illustrating a state in which the shoes care device illustrated in FIG. 2*a* is viewed from another direction.

A shoes care device 1 according to one embodiment of the present invention may include an outer cabinet 20, a door 30, an inner cabinet 100, and a machine room 50. The shoes care device 1 may include a main frame 5.

The outer cabinet 20 and the door 30 may form an overall appearance of the shoes care device 1. The outside of the shoes care device 1 may be formed in a hexahedral shape.

That is, while the outer cabinet 20 and the door 30 are coupled to each other and the door 30 is closed, the appearance of the shoes care device 1 may be formed in a hexahedral shape. However, the shoes care device 1 according to one embodiment of the present invention is not limited to such a shape and may have various three-dimensional shapes.

When the door 30 forms the front of the shoes care device 1, the outer cabinet 20 may form an upper side surface, a left-side surface, a right-side surface, a rear surface, and bottom surfaces of the shoes care device 1.

The main frame 5 may form an overall framework of the shoes care device 1. The main frame 5 may have a hexahedral structure.

The outer cabinet 20 may be detachably fixed to the main frame 5.

The outer cabinet 20 may include an outer rear plate 21, a first outer side plate 22, and a second outer side plate 23.

The outer rear plate 21, the first outer side plate 22, and the second outer side plate 23 may be formed integrally with each other, or the outer rear plate 21, the first outer side plate 22, and the second outer side plate 23 may be individually formed.

The outer rear plate 21 forms a vertically erected wall surface. The outer rear plate 21 may form a surface orthogonal to the first direction (X direction). The outer rear plate 21 may form a rear wall surface in the first direction (X direction) on the outer cabinet 20. The outer rear plate 21 may form a rear surface in the first direction (X direction) in the shoes care device 1. The outer rear plate 21 may form an entire outer rear surface of the shoes care device 1.

The first outer side plate 22 and the second outer side plate 23 form vertically erected wall surfaces, respectively, and form opposing wall surfaces facing each other.

The first outer side plate 22 is disposed at any one side with respect to a reference plane RP that is parallel to the first direction (X direction) as a horizontal direction and is a vertical plane. The second outer side plate 23 is disposed on the opposite side of the first outer side plate 22 with respect to the reference plane RP. The first outer side plate 22 may form a left wall surface of the outer cabinet 20, and the second outer side plate 23 may form a right wall surface of the outer cabinet 20.

The outer cabinet 20 may be disposed outside the inner cabinet 100 and the machine room 50 to form an outer wall surface of the machine room 50. When a separate cabinet for the machine room 50 is not provided in the shoes care device 1, the outer cabinet 20 may form a wall separating the machine room 50 from the outside.

The door 30 is configured to open and close the inside of the shoes care device 1. The door 30 may form any one surface of the shoes care device 1. The door 30 may form a left side or a right side of the shoes care device 1, or may form a front side of the shoes care device 1.

In the shoes care device 1, the door 30 may be hinge-coupled.

In one embodiment, the door 30 may be hinge-coupled to the main frame 5. In another embodiment, the door 30 may be hinge-coupled to the outer cabinet 20, and in another embodiment, the door 30 may be hinge-coupled to the inner cabinet 100 and/or the machine room 50.

A hinge rotation axis 31 of the door 30 may be formed in the vertical direction. That is, in the shoes care device 1, the door 30 may be configured to be rotatable bidirectionally around a rotation axis 31 in the vertical direction.

In one embodiment, the shoes care device 1 may include one door 30. In another embodiment, the shoes care device 1 may include two or more doors.

When two doors are provided in the shoes care device 1, each door may be individually rotated around each rotation axis.

The first direction (X direction) described in one embodiment of the present invention may be parallel to or substantially parallel to the horizontal direction.

In one embodiment, the first direction (X direction) may be a direction from the rear of the shoes care device 1 to the front.

Hereinafter, except for a particularly limited case, it will be described that the door 30 is formed in a front side of the shoes care device 1. That is, a surface on which the door 30 is formed in the shoes care device 1 is described as a front surface of the shoes care device 1.

Furthermore, hereinafter, except for a particularly limited case, it will be described that the first direction (X direction) is parallel to the front-rear direction, the second direction (Y direction) is parallel to the left-right direction, and the third direction (Z direction) is parallel to the vertical direction.

The inner cabinet 100 and the machine room 50 may be provided inside the outer cabinet 20.

The inner cabinet 100 may be formed in a box shape, and a predetermined space may be formed therein. The space inside the inner cabinet 100 forms an accommodation space 101, and shoes S may be accommodated in the accommodation space 101.

A plurality of shoes S may be disposed together in the accommodation space 101 of one inner cabinet 100.

The inner cabinet 100 may be fixed to the main frame 5.

The inner cabinet 100 has a predetermined size along the first direction (X direction), the second direction (Y direction), and the third direction (Z direction).

The inner cabinet 100 is formed in the shape of a box opened to any one side. The inner cabinet 100 may be formed in a form opened to the front side of the shoes care device 1. The inner cabinet 100 may be configured to include a main opening 140. The main opening 140 may be provided to open the front side of the inner cabinet 100 in the first direction (X direction). The shoes may be disposed inside the inner cabinet 100 or withdrawn from the inner cabinet 100 through the main opening 140.

The main opening 140 of the inner cabinet 100 may be closed or opened by the door 30.

The inner cabinet 100 may include an inner rear plate 110, a first inner side plate 120, a second inner side plate 130, and an inner upper plate 115.

The inner rear plate 110, the first inner side plate 120, the second inner side plate 130, and the inner upper plate 115 may be formed integrally with each other. The inner cabinet 100 may be made of a single material and be formed by injection molding.

The inner rear plate 110 forms a vertically erected wall surface. The inner rear plate 110 may form a surface orthogonal to the first direction (X direction). The inner rear plate 110 may form a rear wall surface of the inner cabinet 100 in the first direction (X direction). The inner rear plate 110 may be formed parallel to the outer rear plate 21.

The first inner side plate 120 and the second inner side plate 130 form vertically erected wall surfaces, respectively, and form opposing wall surfaces facing each other.

The first inner side plate 120 is dispose on either side with respect to the reference plane RP that is parallel to the first direction (X direction) as the horizontal direction and is a vertical surface. The second inner side plate 130 is disposed on the opposite side of the first inner side plate 120 with respect to the reference plane RP. The first inner side plate 120 forms a left wall surface of the inner cabinet 100, and the second inner side plate 130 forms a right wall surface of the inner cabinet 100.

The first inner side plate 120 may be formed parallel to the first outer side plate 22, and the second inner side plate 130 may be formed parallel to the second outer side plate 23.

In one embodiment of the present invention, the inner cabinet 100 may have the form where a lower part thereof is opened. Accordingly, the inner cabinet 100 includes a lower opening formed by opening the lower part thereof. When the inner cabinet 100 is formed in a hexahedral shape on the whole, the lower opening may be formed large to form all or most of a lower surface of the inner cabinet 100.

However, the shoes care device 1 according to one embodiment of the present invention is not used in a state in which an entire lower part of the inner cabinet 100 is opened, but is used in a state in which the inner cabinet 100 and a module housing 200 are coupled to each other so that the lower opening 150 of the inner cabinet 100 is shielded by the module housing 200. That is, the shoes care device 1 is used so that an upper surface of the module housing 200 forms a bottom surface of the accommodation space 101 of the inner cabinet 100. A further explanation thereof will be described below.

A main shelf 40 may be provided in the inside 101 of the inner cabinet 100. The main shelf 40 may be formed such that the shoes S are settled on an upper surface thereof.

The main shelf 40 may be formed in the form of a plate with a predetermined area, or may be formed in the form of a grill where multiple bars are spaced apart from each other.

One main shelf 40 may be provided, or a plurality of main shelves 40 may be provided.

The main shelf 40 may have a substantially flat plate shape and be disposed on a bottom surface of the inner cabinet 100. The main shelf 40 is settled on an upper side of a module cover 202 of the inner cabinet 100. The main shelf 40 may be disposed on the upper side of the module cover 202 of the inner cabinet 100 in a stacked form.

The main shelf 40 is detachable from the inner cabinet 100, and when the main shelf 40 is withdrawn from the inner cabinet 100, the upper surface of the module housing 200 is exposed.

The main shelf 40 may have a rectangular shape when viewed in a plan view. The size of the main shelf 40 may be a size corresponding to the bottom of the accommodation space 101 of the inner cabinet 100. That is, when the main shelf 40 is disposed inside the inner cabinet 100, the main shelf 40 may form all or most of the bottom of the accommodation space 101 of the inner cabinet 100.

In one embodiment, the machine room 50 may be provided in a lower side of the inner cabinet 100. In the machine room 50, some of the components that constitutes the shoes care device 1 may be accommodated, and, in this case, the components that are accommodated in the machine room 50 may be fixed to a main frame 5 or to the inner cabinet 100 or the outer cabinet 20.

Figure 3:
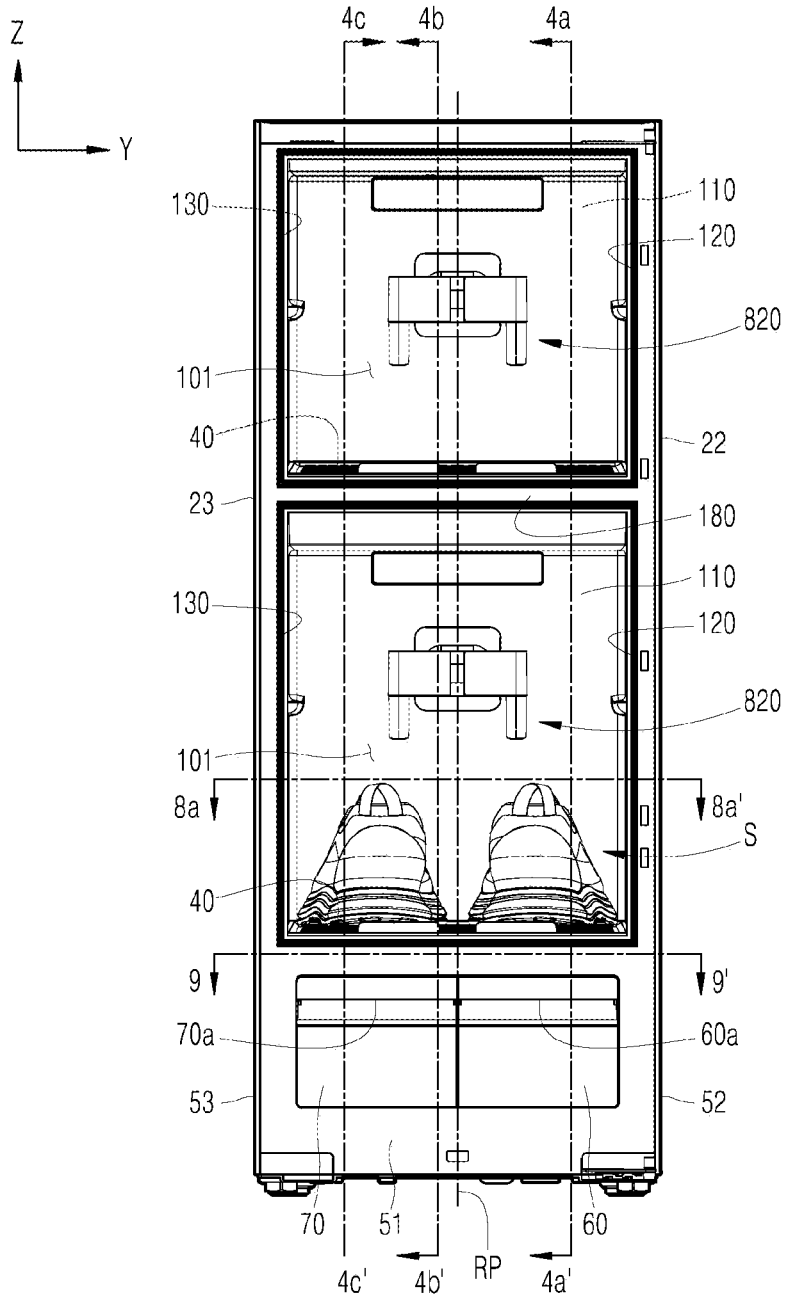
FIG. 3 is a front view illustrating a state in which a door is removed from the shoes care device illustrated in FIG. 1*b*.

FIG. 3 is a front view illustrating a state in which a door is removed from the shoes care device illustrated in FIG. 1*b*. FIG. 3 illustrates shoes accommodated in an inner cabinet together.

Figure 4A:
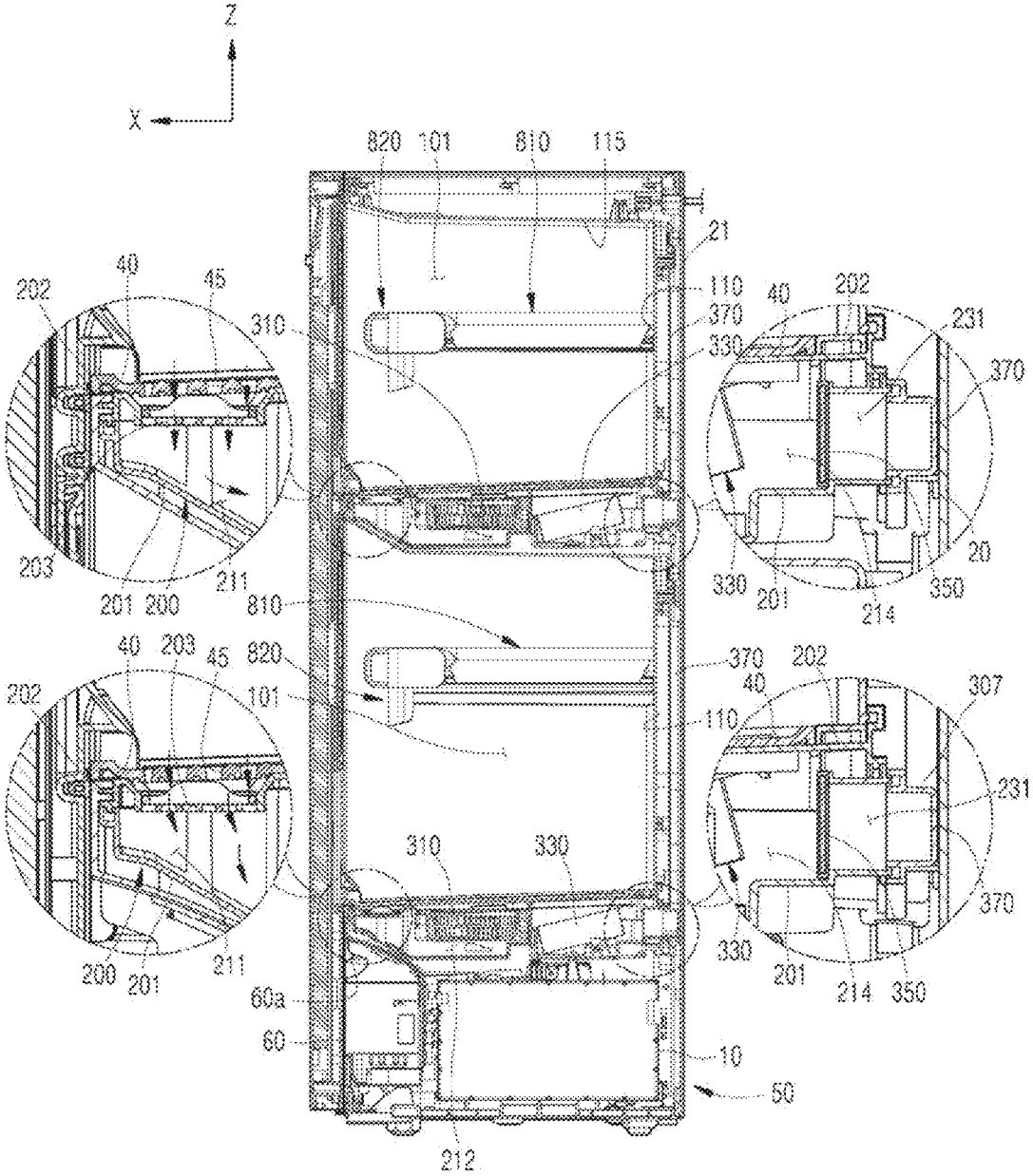
FIG. 4*a* is a cross-sectional view taken along line A-A'4*a*-4*a*' of the shoes care device illustrated in FIG. 3.
Figure 4B:
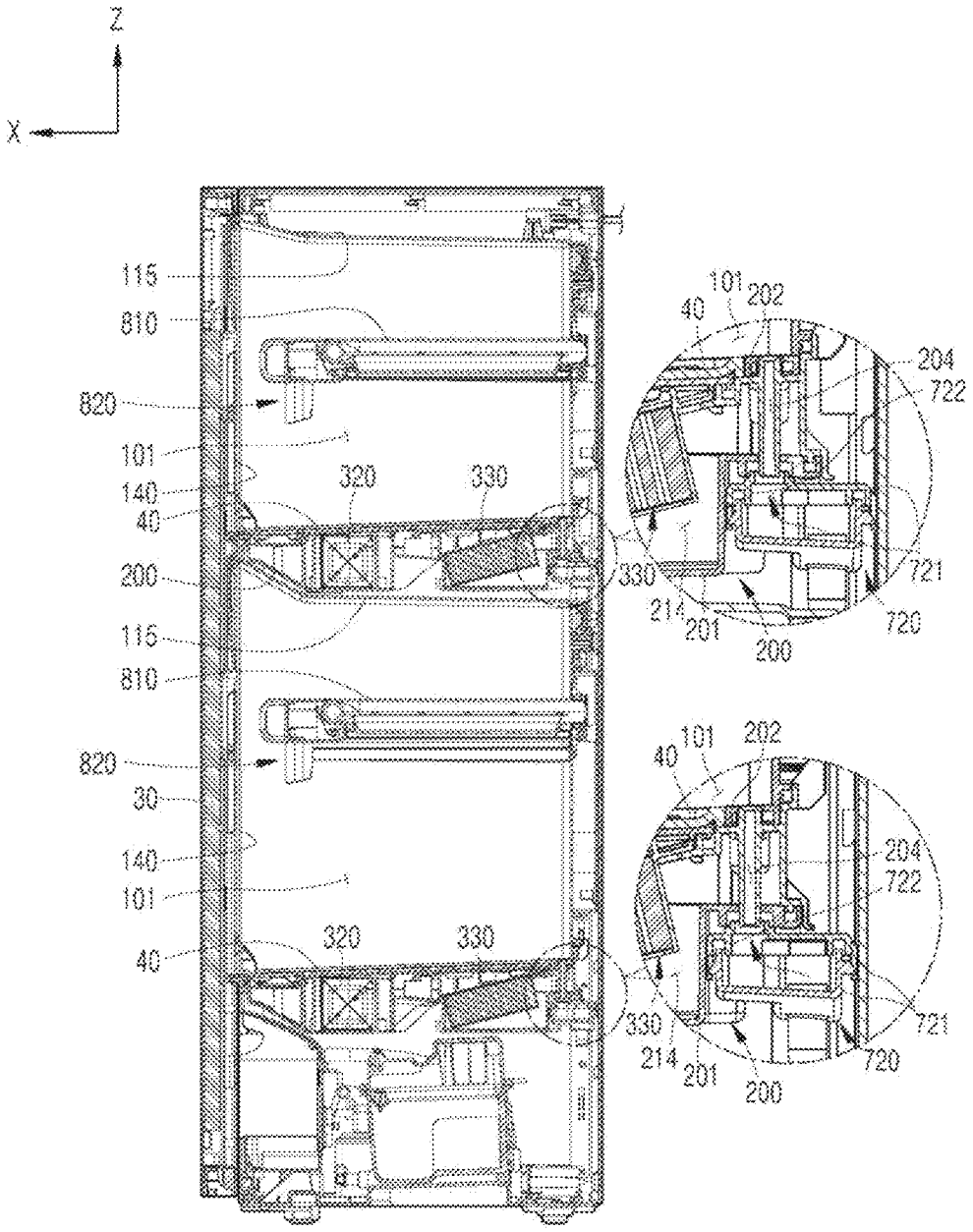
FIG. 4*b* is a cross-sectional view taken along line B-B'4*b*-4*b*' of the shoes care device illustrated in FIG. 3.
Figure 4C:
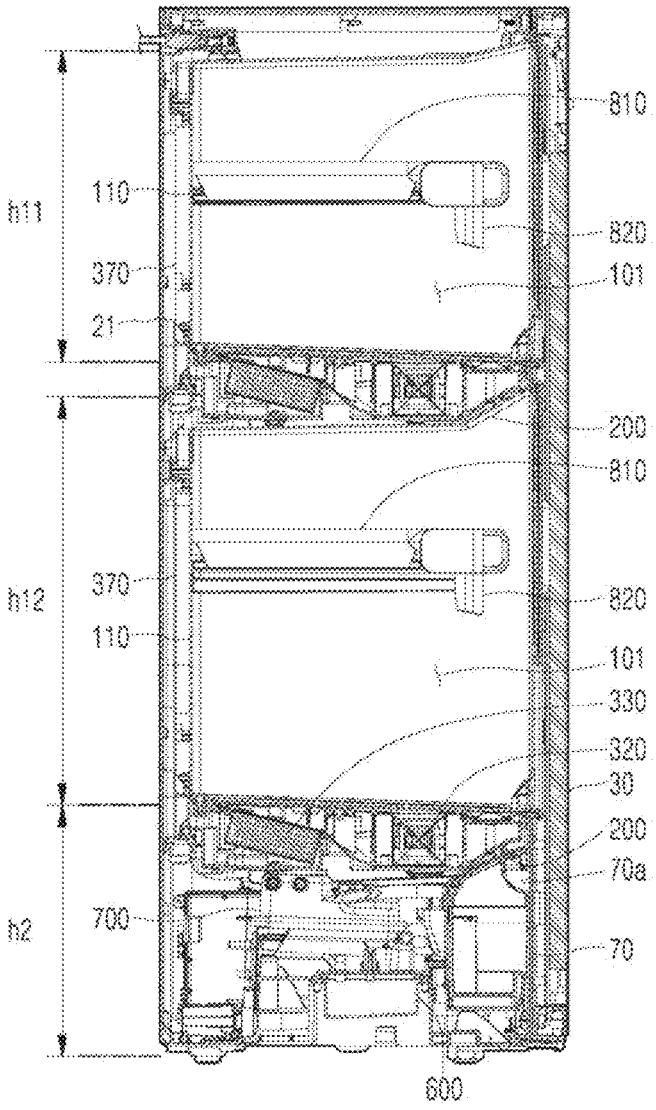
FIG. 4*c* is a cross-sectional view taken along line C-C'4*c*-4*c*' of the shoes care device illustrated in FIG. 3.

FIG. 4*a* is a cross-sectional view taken along line 4*a*-4*a*' of the shoes care device illustrated in FIG. 3, FIG. 4*b* is a cross-sectional view taken along line 4*b*-4*b*' of the shoes care device illustrated in FIG. 3, and FIG. 4*c* is a cross-sectional view taken along line 4*c*-4*c*' of the shoes care device illustrated in FIG. 3. FIGS. 4*a* to 4*c* illustrate a form where a door is included in the shoes care device, and do not illustrate shoes.

The shoes care device 1 according to one embodiment of the present invention includes management devices 2*a* and 2*b*. In the shoes care device 1, a plurality of management devices 2*a* and 2*b* may be provided. In one embodiment, the shoes care device 1 may include a first management device 2*a* and a second management device 2*b*. That is, the shoes care device 1 may include two separate management devices 2*a* and 2*b*.

The 'management device' described in the present invention may refer to a 'first management device 2*a*' and a 'second management device 2*b*', respectively, except for a particularly limited case.

The management devices 2*a* and 2*b* include the above-described inner cabinet 100.

In one embodiment of the present invention, since the inner cabinet 100 of the first management device 2*a* and the inner cabinet 100 of the second management device 2*b* may be distinguished from each other, the inner cabinet 100*a* of the first management device 2*a* may refer to a first inner cabinet 100*a*, and inner cabinet 100*b* of the second management device 2*b* may refer to a second inner cabinet 100*b*.

It may be understood that the 'inner cabinet 100' described in one embodiment of the present invention refers to each of the 'first inner cabinet 100*a*' and the 'second inner cabinet 100*b*', except for a particularly limited case.

When the door 30 is closed in the shoes care device 1, the door 30 closes the main opening 140 of the first management device 2*a* and also closes the main opening 140 of the second management device 2*b*. That is, the door 30 may simultaneously seal the accommodation space 101 of the inner cabinet 100 of the first management device 2*a* and the accommodation space 101 of the inner cabinet 100 of the second management device 2*b*. In this case, the accommodation space 101 of the inner cabinet 100 of the first management device 2*a* and the accommodation space 101 of the inner cabinet 100 of the second management device 2*b* may be configured such that they do not communicate with each other.

As described above, in one embodiment of the present invention, the accommodation space 101 of the inner cabinet 100 of the first management device 2*a* and the accommodation space 101 of the inner cabinet 100 of the second management device 2*b* may form independent spaces, and may form blocked spaces (not communicating with each other). Accordingly, the temperature and humidity of the accommodation space 101 of the first management device 2*a* and the temperature and humidity of the accommodation space 101 of the second management device 2*b* may be controlled differently from each other.

The management devices 2*a* and 2*b* may be configured to include a connection path F10. The management devices 2*a* and 2*b* may be configured to include a blowing part 310 and a dehumidifying part 330. The management devices 2*a* and 2*b* may include an outlet 203 and a nozzle 820.

The management devices 2*a* and 2*b* may include the module housing 200 forming a connection path F10.

The management devices 2*a* and 2*b* may include a regeneration path F20. The management devices 2*a* and 2*b* may include a heating part 320.

The management devices 2*a* and 2*b* may include a conversion flow path F10*a*.

The management devices 2*a* and 2*b* may include a damper 350.

The shoes care device 1 may include a steam generator 700 and a steam valve 710.

The shoes care device 1 may include a sump 600, a water supply tank 60, and a drain tank 70.

Since all or part of the outer cabinet 20 may be spaced apart from the inner cabinet 100, a predetermined gap may be formed between the inner cabinet 100 and the outer cabinet 20.

In a space between the inner cabinet 100 and the outer cabinet 20, components constituting the shoes care device 1 may be provided, and various flow paths constituting the shoes care device 1 may be provided. In one embodiment of the present invention, part of the connection path F10 may be provided between the inner cabinet 100 and the outer cabinet 20, and part of the regeneration path F20 may be provided between the inner cabinet 100 and the outer cabinet 20.

A dry air duct 370 forming the connection path F10 may be provided between the outer rear plate 21 and the inner rear plate 110. Furthermore, a condenser 400 forming the regeneration path F20 may be provided between the first outer side plate 22 and the first inner side plate 120. The connection path F10 forms a flow path of a fluid.

The connection path F10 forms a passage through which air and/or condensed water inside the shoes care device 1 moves.

The dehumidifying part 330 is disposed inside the connection path F10 and includes a dehumidifying material. The dehumidifying part 330 may be entirely formed of the dehumidifying material, or a part thereof may be formed of the dehumidifying material. A further explanation of the dehumidifying part 330 will be described below.

According to one embodiment of the present invention, the shoes care device 1 has an air circulation structure in which the air inside the inner cabinet 100 in which the shoes are disposed is sucked into the connection path F10 to dehumidify the air using a dehumidifying material 331 and the dehumidified air may be supplied back into the inner cabinet 100.

The connection path F10 may be used as a means to achieve such an air circulation structure in the shoes care device 1. All or part of the connection path F10 may be formed of a pipe, a hose, a tube, a duct, a housing, or a combination thereof.

The module housing 200 according to one embodiment of the present invention forms part of the connection path F10.

The outlet 203 is formed in the module housing 200. The outlet 203 communicates with the accommodation space 101 of the inner cabinet 100, and forms an inlet of the module housing 200 through which the air of the accommodation space 101 of the inner cabinet 100 is suctioned into the module housing 200. The outlet 203 may be disposed below the main shelf 40. In this case, the main shelf 40 may be formed so as not to block the air in the accommodation space 101 from being sucked into the outlet 203. To this end, when the main shelf 40 is formed in a plate shape, a plurality of holes 45 penetrating in the vertical direction may be formed in the main shelf 40 so as to move the air.

In the shoes care device 1, the inner cabinet 100 and the machine room 50 may form a space separated from each other. Furthermore, the module housing 200 that is part of the management devices 2*a* and 2*b* may be provided between the inner cabinet 100 and the machine Toom 50.

The inner cabinet 100, the module housing 200, and the machine room 50 are provided inside the shoes care device 1 according to one embodiment of the present invention.

The inner cabinet 100, the module housing 200, and the machine room 50 may be continuously arranged from the upper side to the lower side. When the shoes care device 1 according to one embodiment of the present disclosure includes the first management device 2*a* and the second management device 2*b*, the first management device 2*a* may be disposed above the second management device 2*b*. That is, the first management device 2*a*, the second management device 2*b*, and the machine room 50 may be continuously arranged from the upper side to the lower side.

Since the first management device 2*a* and the second management device 2*b* include the inner cabinet 100 and the module housing 200, respectively, they may be continuously arranged in an order of the inner cabinet 100 of the first management device 2*a*, the module housing 200 of the first management device 2*a*, the inner cabinet 100 of the second management device 2*b*, the module housing 200 of the second management device 2*b*, the machine room 50 from the upper side to the lower side.

The inner cabinet 100 may form a space that mainly accommodates an article (shoes S) to be managed, and the module housing 200 and the machine room 50 may form a space that mainly accommodates components for an operation of the shoes care device 1.

In the shoes care device 1 according to one embodiment of the present invention, the blowing part 310, the dehumidifying part 330 (and the dehumidifying material 331), and the heating part 320 may be accommodated inside the module housing 200.

In addition, the machine room 50 may be configured to accommodate a controller 10, the sump 600, the steam generator 700, and the steam valve 710 therein. Furthermore, the machine room 50 may be configured to accommodate the water supply tank 60 and the drain tank 70.

Among the components constituting the management devices 2*a* and 2*b*, components not included in the module housing 200 may be fixedly coupled to the inner cabinet 100 and the outside of the module housing 200 or may be fixedly coupled to the main frame 5.

Components coupled to or accommodated in the machine room 50 may be fixedly coupled to the machine room 50.

The machine room 50 may include a first wall 51.

A first wall 51 forms one wall surface of the machine room 50. The first wall 51 may be erected in the vertical direction, or may be erected in the substantially vertical direction. In one embodiment, the first wall 51 may form a wall surface orthogonal to or inclined with the first direction (X direction).

The first wall 51 may form a front wall surface of the machine room 50, a left wall of the machine room 50, or a right wall of the machine room 50.

The machine room 50 may include a second wall 52 and a third wall 53. The second wall 52 and the third wall 53 form opposite wall surfaces facing each other in the machine room 50. The second wall 52 and the third wall 53 may be erected in the vertical direction, or may be erected in the substantially vertical direction.

When the first wall 51 forms a front wall of the machine room 50, the second wall 52 may form a left wall of the machine room 50, and the third wall 53 may form a right wall of the machine room 50.

The first wall 51 may be formed integrally with the inner cabinet 100, and the second wall 52 and the third wall 53 may be formed integrally with the outer cabinet 20, respectively.

Each of the water supply tank 60 and the drain tank 70 may be formed in the form of a container for accommodating water.

The water supply tank 60 may be configured to store water supplied into the shoes care device 1 inside. The water supply tank 60 may be configured to store water supplied into the steam generator 700 inside.

In order to supply water from the water supply tank 60 into the shoes care device 1, a water pump 61 may be connected to the water supply tank 60. The water supply tank 60 and the first water pump 61 may be connected by a pipe, a hose, etc.

The drain tank 70 may be configured to store water discharged from the shoes care device 1 inside. The drain tank 70 may store water condensed inside the shoes care device 1. The drain tank 70 may be configured to store water drained from the sump 600.

In order to discharge water to the drain tank 70, a water pump 71 (a second water pump) may be connected to the drain tank 70. The drain tank 70 and the second water pump 71 may be connected by a pipe, a hose, etc.

The water supply tank 60 and the drain tank 70 may be coupled to the machine room 50 to get exposed from the outside of one wall surface of the machine room 50.

The water supply tank 60 and the drain tank 70 may be disposed in front of the machine room 50.

The water supply tank 60 and the drain tank 70 may form one wall surface of the machine room 50 along with the first wall 51. When the first wall 51 forms a front surface of the machine room 50, the water supply tank 60 and the drain tank 70 may be exposed from a front side of the machine room 50, and may be coupled to the machine room 50 to get exposed from the outside of the first wall 51.

As the water supply tank 60 and the drain tank 70 are exposed to the outside of the first wall 51, a user may inject water into the water supply tank 60 or discharge water from the drain tank 70.

The water supply tank 60 and the drain tank 70 may be configured to be detachable from the machine room 50. The water supply tank 60 and the drain tank 70 may be detached from the first wall 51. In order to facilitate the attachment and detachment of the water supply tank 60 and the drain tank 70, a handle 60*a* of the water supply tank 60 may be formed on an outer surface of the water supply tank 60, and a handle 70*a* of the drain tank 70 may be formed on an outer surface of the drain tank 70.

Each of the water supply tank 60 and the drain tank 70 may be configured to be separated from the machine room 50 in an outer direction of the first wall 51.

The controller 10 may be configured to control operations of each component in connection with each component constituting the shoes care device 1.

In order to control the controller 10, the shoes care device 1 may be provided with a storage medium in which an application program is stored, and the controller 10 may be configured to control the shoes care device 1 by driving an application program according to information input to the shoes care device 1 and information output from the shoes care device 1.

The controller 10 may control the first management device 2*a* and the second management device 2*b* constituting the shoes care device 1 to operate individually. The controller 10 may control the first management device 2*a* and the second management device 2*b* to operate in different states, and may control shoes (e.g., sneakers) in the first management device 2*a* and shoes (e.g., heels) in the second management device 2*b* to be managed under different conditions. Furthermore, the controller 10 may control the first management device 2*a* and the second management device 2*b* to interwork with each other.

The door 30 may be disposed on either the inner cabinet 100 or the machine room 50 on the same side as the first wall 51. When the door 30 forms the front surface of the shoes care device 1, the first wall 51 forms the front surface of the machine room 50, and the door 30 is disposed directly outside the first wall 51.

In one embodiment of the present invention, the door 30 may be configured to open and close the inner cabinet 100 and further expose or shield the front surface of the machine room 50.

The door 30 may be configured to expose or shield the inner cabinet 100, the water supply tank 60, and the drain tank 70.

As described above, in the shoes care device 1, the door 30, the water supply tank 60, and the drain tank 70 are formed on the same side, and when the door 30 is opened, the water supply tank 60 and the drain tank 70 may be exposed and separated from the shoes care device 1.

In the arrangement explained above, even if left and right sides and a rear side of the shoes care device 1 are blocked by other goods or structures, the door 30 may be opened on a front side of the shoes care device 1, and the water supply tank 60 and the drain tank 70 can be separated from or coupled again to the shoes care device 1.

A control panel 33 for controlling the shoes care device 1 is provided on an outer side of the door 30. The control panel 33 may be formed of a touch screen. A control unit (controller 10) is provided in the inner space of the door 30 to control each component of the shoes care device 1 in connection with the control panel 33. The controller 10 may be provided inside the machine room 50.

As illustrated in FIGS. 1*a* and 1*b*, in one embodiment, the door 30 may be configured to simultaneously expose or shield the inner cabinet 100 and the machine room 50.

In another embodiment, the door 30 may be configured to open and close only the inner cabinet 100. In this case, the machine room 50 may not be shielded by the door 30. Furthermore, in this case, the shoes care device 1 according to one embodiment of the present invention may be further provided with a dedicated door of the machine room 50 to open and close the machine room 50 separately from the door 30.

Figure 5:
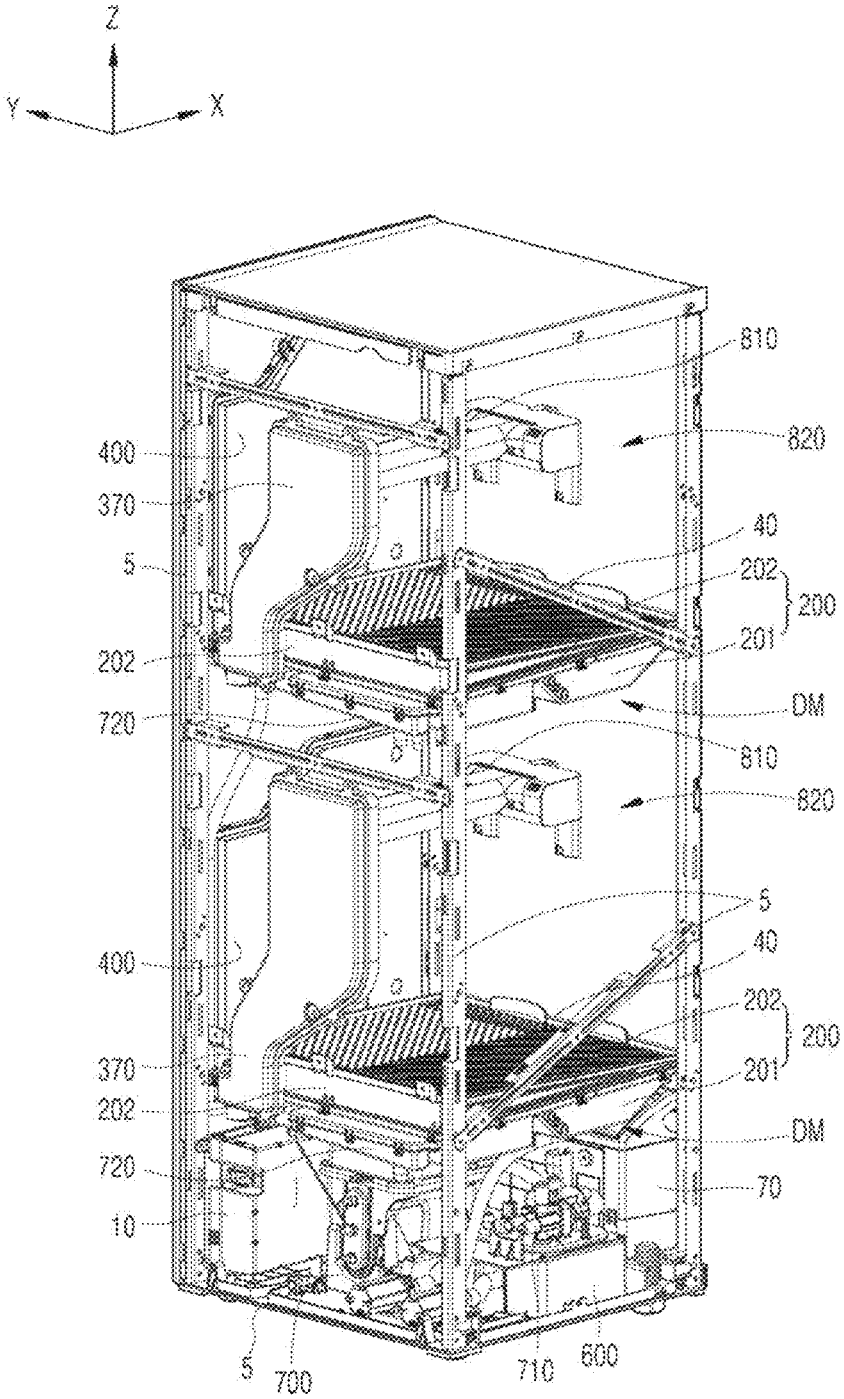
FIG. 5 is a perspective view illustrating a state in which the door, the outer cabinet, and the inner cabinet are removed from the shoes care device according to one embodiment of the present invention.

FIG. 5 is a perspective view illustrating a state in which the door 30, the outer cabinet 20, and the inner cabinet 100 are removed from the shoes care device 1 according to one embodiment of the present invention.

Figure 6:
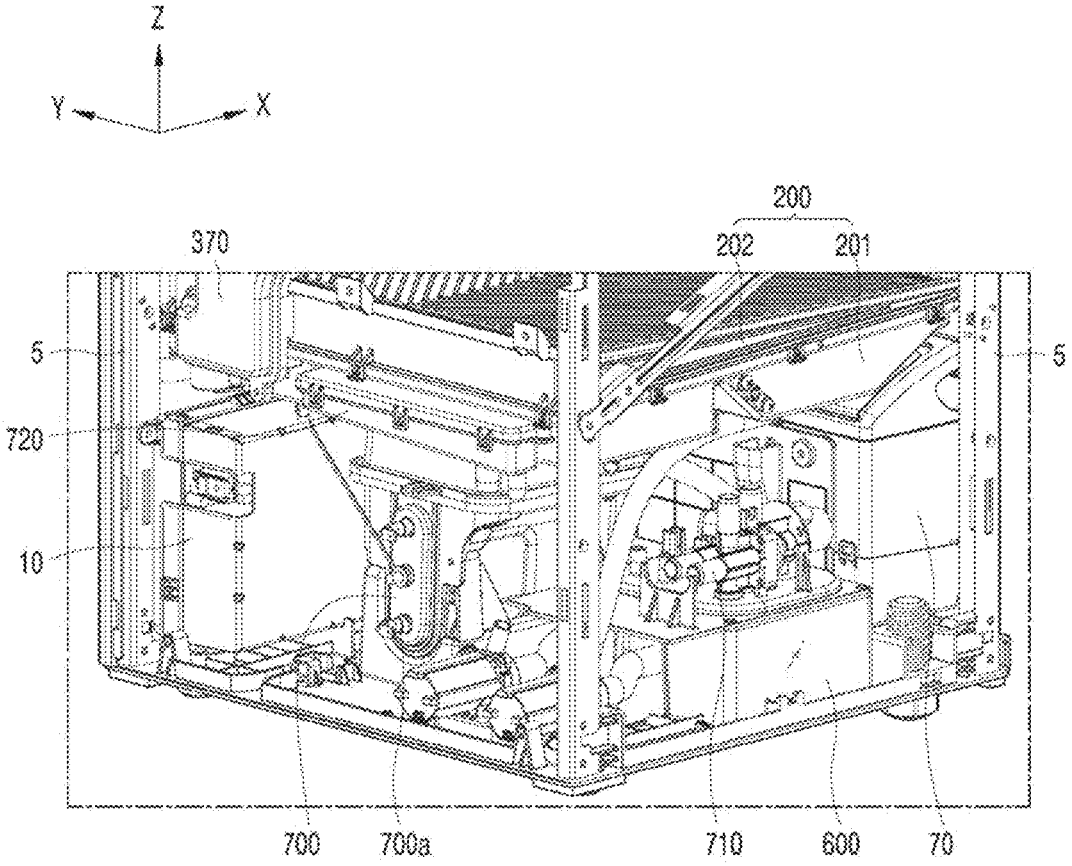
FIG. 6 is a perspective view illustrating a part of a machine room of the shoes care device illustrated in FIG. 5.

FIG. 6 is a perspective view illustrating a machine room part of the shoes care device 1 illustrated in FIG. 5.

Figure 7A:
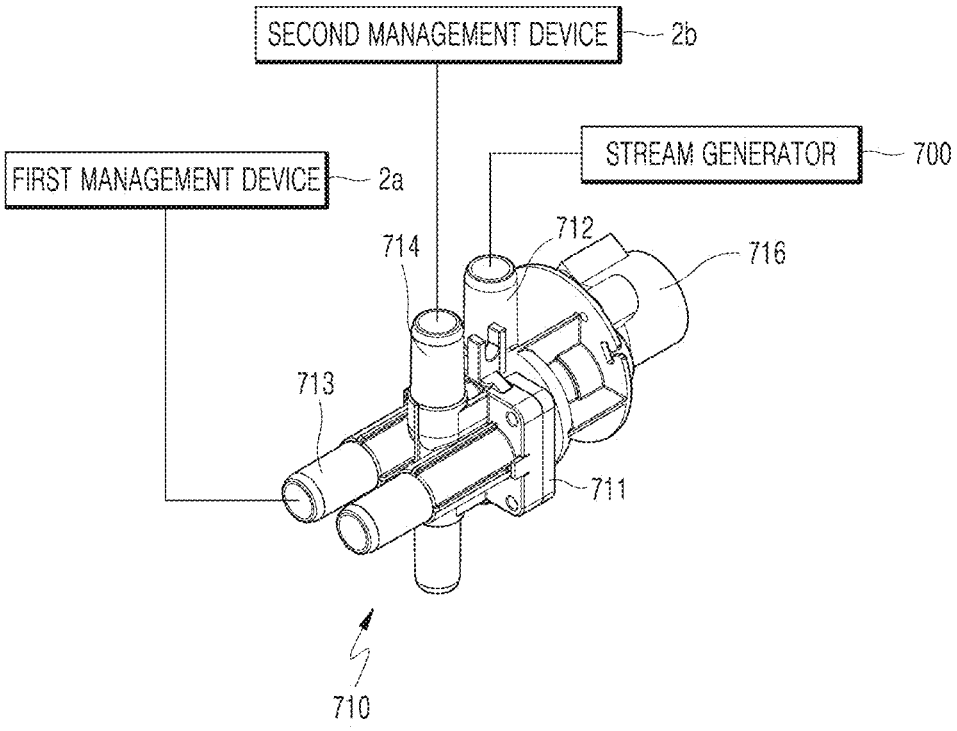
FIG. 7*a* is a view illustrating a steam valve according to one embodiment of the present invention, and illustrating a connection relationship considering the movement of steam.
Figure 7B:
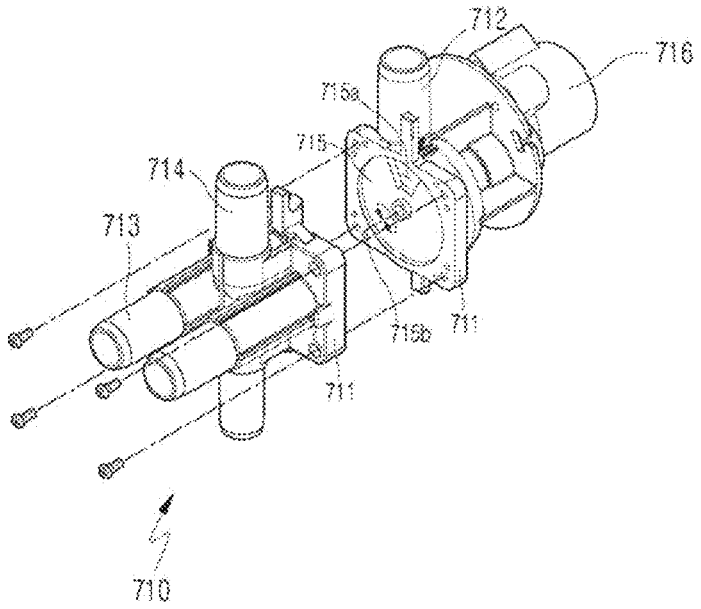
FIG. 7*b* is an exploded perspective view illustrating the steam valve illustrated in FIG. 7*a*.

FIG. 7*a* is a view illustrating the steam valve 710 according to one embodiment of the present invention, and illustrating a connection relationship considering the movement of steam. FIG. 7*b* is an exploded perspective view illustrating the steam valve illustrated in FIG. 7*a*.

The shoes care device 1 is provided with the steam generator 700 as a device configured so as to generate moisture inside the inner cabinet 100. The steam generator 700 may be provided inside the machine room 50. The steam generator 700 is configured to generate steam and selectively supply moisture and steam to the inside of the inner cabinet 100.

The shoes care device 1 according to one embodiment may be provided with one steam generator 700, and the shoes care device 1 according to another embodiment may be provided with two or more steam generators 700.

When the shoes care device 1 is provided with one steam generator 700, the steam generator 700 may be configured to supply steam into the inner cabinet 100 of the first management device 2*a* and/or into the inner cabinet 100 of the second management device 2*b*.

When the shoes care device 1 is provided with two or more steam generators 700, one of the steam generators 700 may supply steam to the inner cabinet 100 of the first management device 2*a*, and the other steam generator 700 may supply steam to the inner cabinet 100 of the second management device 2*b*.

Moist air formed by the steam generator 700 ('air' described in one embodiment of the present invention may be 'air including moisture') is supplied toward the accommodation space 101 of the inner cabinet 100, and moisture may be circulated in the accommodation space 101 of the inner cabinet 100, and accordingly, the moisture may be supplied to the shoes S.

The shoes care device 1 according to one embodiment of the present invention may be a refresher device that refreshes the shoes.

Here, refreshing may refer to a process of removing contaminants, deodorizing, sanitizing, preventing static electricity, or warming by supplying air, heated air, water, mist, steam, etc. to the shoes.

The steam generator 700 may supply steam to the accommodation space 101 of the inner cabinet 100 in which the shoes S are accommodated, and may perform steam treatment on the shoes, which is further meant to exert a refreshing effect due to swelling of shoes materials as well as sterilization by high-temperature steam.

The steam generator 700 is provided with a separate heater 700*a* that heats an inner space and water in the inner space and is configured to heat water to generate steam and supply the heated water to the accommodation space 101 of the inner cabinet 100.

An external faucet, etc., as a water supply source for supplying water to the steam generator 700, may be used, or a container-type water supply tank provided on one side of the machine room 50 may be used. The steam generator 700 may generate steam by receiving water from the water supply tank 60.

The water supply tank 60 and the steam generator 700 may be connected by a pipe, a hose, etc.

The steam generator 700 and the inner cabinet 100 may be connected by a pipe, a hose, etc. In the shoes care device 1 according to one embodiment of the present invention, as described below, the steam generated by the steam generator 700 may be supplied into the inner cabinet 100 after passing through the steam valve 710 and a steam separator 720. In this case, in order to move the steam, the steam generator 700 and the steam valve 710 may be connected by a pipe, a hose, etc., and the steam valve 710 and the steam separator 720 may also be connected by a pipe, a hose, etc.

The steam valve 710 may be disposed adjacent to the steam generator 700, and the steam valve 710 may be provided in the machine room 50. The steam generator 700 and the steam valve 710 may be provided below the second management device 2*b*.

The steam valve 710 is configured to selectively communicate with each of the accommodation space 101 of the first management device 2*a* and the accommodation space 101 of the second management device 2*b*, respectively.

When the steam of the steam generator 700 is supplied to the accommodation space 101 of the first management device 2*a* and/or the accommodation space 101 of the second management device 2*b*, the steam valve 710 operates to control whether the stream is supplied or not, and an operation of the stream 710 is driven by the controller 10.

The steam valve 710 includes a valve housing 711, a valve inlet 712, a first valve outlet 713, a second valve outlet 714, a valve disk 715, and a valve motor 716. In the steam valve 710 illustrated in FIGS. 7*a* and 7*b*, the other outlets except the valve inlet 712, the first valve outlet 713, and the second valve outlet 714 may be blocked by a stopper and deactivated.

The valve housing 711 forms a body of the steam valve 710, and has a predetermined inner space formed inside.

The valve inlet 712 may have a tubular shape and be coupled to the valve housing 711 to communicate with the inner space of the valve housing 711. The valve inlet 712 is a part connected to the steam generator 700, and steam may flow into the steam valve 710 (inside the valve housing 711) through the valve inlet 712.

The first valve outlet 713 and the second valve outlet 714 may be formed in a tubular shape and be coupled to the valve housing 711 to communicate with the inner space of the valve housing 711.

The first valve outlet 713 and the second valve outlet 714 are outlets through which steam is discharged from the steam valve 710. The first valve outlet 713 is connected to the accommodation space 101 of the first management device 2*a*, and the second valve outlet 714 is connected to the accommodation space 101 of the second management device 2*b*.

The valve disk 715 is provided inside the steam valve 710 (inside the valve housing 711) and is configured to open and close a flow path inside the steam valve 710. The valve disk 715 may be configured to selectively open and close a flow path of the first valve outlet 713 and a flow path of the second valve outlet 714.

The valve disk 715 is disposed between the valve inlet 712 and the first valve outlet 713, or between the valve inlet 712 and the second valve outlet 714, inside the valve housing 711. The valve disk 715 allows the valve inlet 712 and the first valve outlet 713 to communicate with each other or block the communication therewith, and also allows the valve inlet 712 and the second valve outlet 714 to communicate with each other or block the communication therewith.

In one embodiment of the present invention, the valve disk 715 may be formed in a circular plate shape and may include a valve hole 715*a*. The valve hole 715*a* is a hole penetrating the valve disk 715. The valve disk 715 may be rotatably coupled to the valve housing 711 around a valve rotation axis 715*b*, and the valve hole 715*a* may be formed eccentrically from the valve rotation axis 715*b*.

The valve motor 716 is coupled to the valve housing 711, and the valve motor 716 is coupled to the rotation axis 715*b* of the valve disk 715 to rotate the valve disk 715.

The controller 10 may control the steam valve 710 by controlling an operation of the valve motor 716.

The valve disk 715 rotates by the operation of the valve motor 716, and the valve disk 715 opens or closes a flow path inside the steam valve 710 (inside the valve housing 711) depending on the degree of rotation of the valve disk 715.

In one embodiment, depending on the degree of rotation of the valve disk 715, when the valve inlet 712 and the first valve outlet 713 communicate with each other through the valve hole 715*a*, the valve inlet 712 and the second valve outlet 714 are blocked from communicating with each other by the valve disk 715, or when the valve inlet 712 and the second valve outlet 714 communicate with each other through the valve hole 715*a*, the valve outlet 712 and the first valve outlet 713 may be blocked from communicating with each other by the valve disk 715.

In another embodiment, depending on the degree of rotation of the valve disk 715, the valve inlet 712 may communicate with both the first valve outlet 713 and the second valve outlet 714, or the valve inlet 712 may be blocked from communicating with both the first valve outlet 713 and the second valve outlet 714.

In the shoes care device 1 according to one embodiment of the present invention, the valve disk 715 may close a flow path of the second valve outlet 714 while opening a flow path of the first valve outlet 713, and may also close the flow path of the first valve outlet 713 and open the flow path of the second valve outlet 714.

The steam valve 710 made as described above may operate such that only the valve inlet 712 and the first valve outlet 713 communicate with each other, or only the valve inlet 712 and the second valve outlet 714 communicate with each other.

In the arrangement explained above, all the steam generated by the steam generator 700 may be supplied to the accommodation space 101 of the first management device 2*a*, or may be supplied to the accommodation space 101 of the second management device 2*b*. In this case, the steam generated by the steam generator 700 may be supplied to the accommodation space 101 of the first management device 2*a* or the accommodation space 101 of the second management device 2*b* without a pressure drop, and even when only one steam generator 700 is provided in the shoes care device 1, the steam may be sufficiently and stably supplied to the accommodation spaces 101 of each of the two inner cabinets 100.

In one embodiment of the present invention, the controller 10 may control the stream valve 710 such that when the heating part 320 of the first management device 2*a* is turned off (when a heater 321 of the heating part 320 is turned off), the valve disk 715 closes or opens the first valve outlet 713, and when the heating part 320 of the first management device 2*a* is turned on (when the heater 321 of the heating part 320 is turned on), the valve disk 715 closes the first valve outlet 713.

In addition, the controller 10 may control the stream valve 710 such that when the heating part 320 of the second management device 2*b* is turned off (when the heater 321 of the heating part 320 is turned off), the valve disk 715 closes or opens the second valve outlet 714, and when the heating part 320 of the second management device 2*b* is turned on (when the heater 321 of the heating part 320 is turned on), the valve disk 715 closes the second valve outlet 714.

In the shoes care device 1 according to one embodiment of the present invention, by controlling the steam valve 710 by the controller 10, the steam generated in the steam generator 700 may be selectively or simultaneously supplied to the accommodation space 101 of the first management device 2*a* and the accommodation space 101 of the second management device 2*b*, and whether the steam is supplied or not may be controlled according to a use state of the shoes care device 1.

Figure 8A:
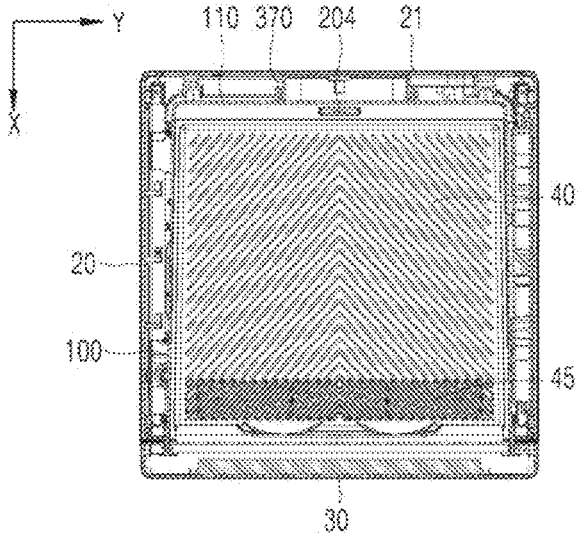
FIG. 8*a* is a cross-sectional view taken along line D-D'8*a*-8*a*' of the shoes care device illustrated in FIG. 3.

FIG. 8*a* is a cross-sectional view taken along line 8*a*-8*a*' of the shoes care device 1 illustrated in FIG. 3.

Figure 8B:
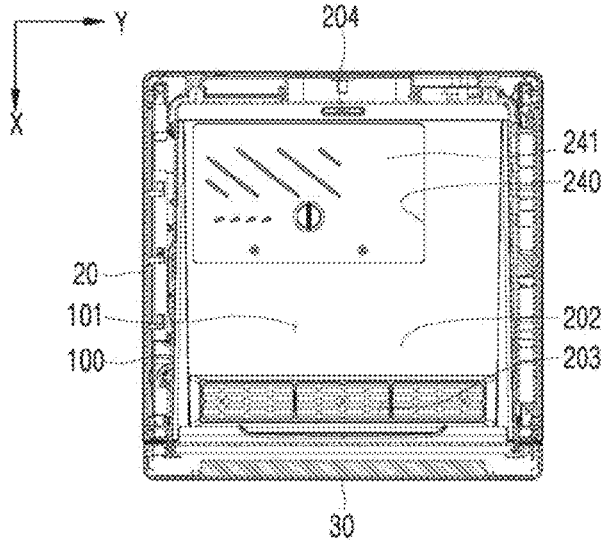
FIG. 8*b* is a view illustrating a state in which a main shelf is removed from the shoes care device illustrated in FIG. 8*a*.

FIG. 8*b* is a view illustrating a state in which the main shelf 40 is removed from the shoes care device 1 illustrated in FIG. 8*a*.

Figure 9:
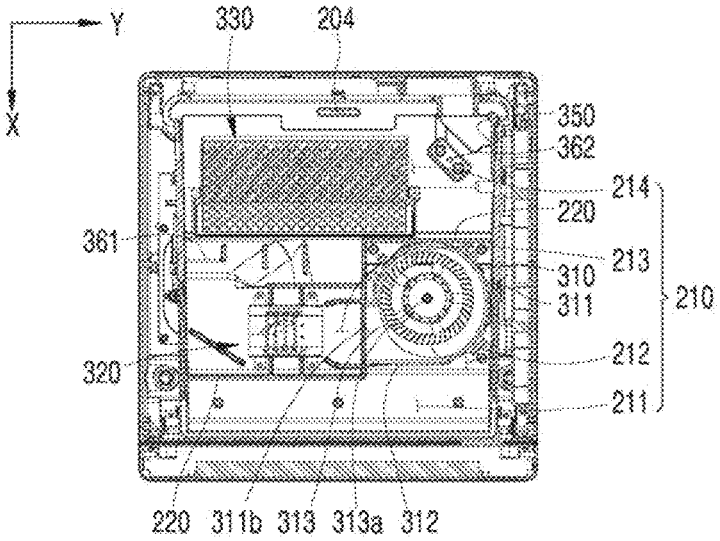
FIG. 9 is a cross-sectional view taken along line 9-9' of the shoes care device illustrated in FIG. 3.

FIG. 9 is a cross-sectional view taken along line 9-9' of the shoes care device 1 illustrated in FIG. 3.

Figure 10A:
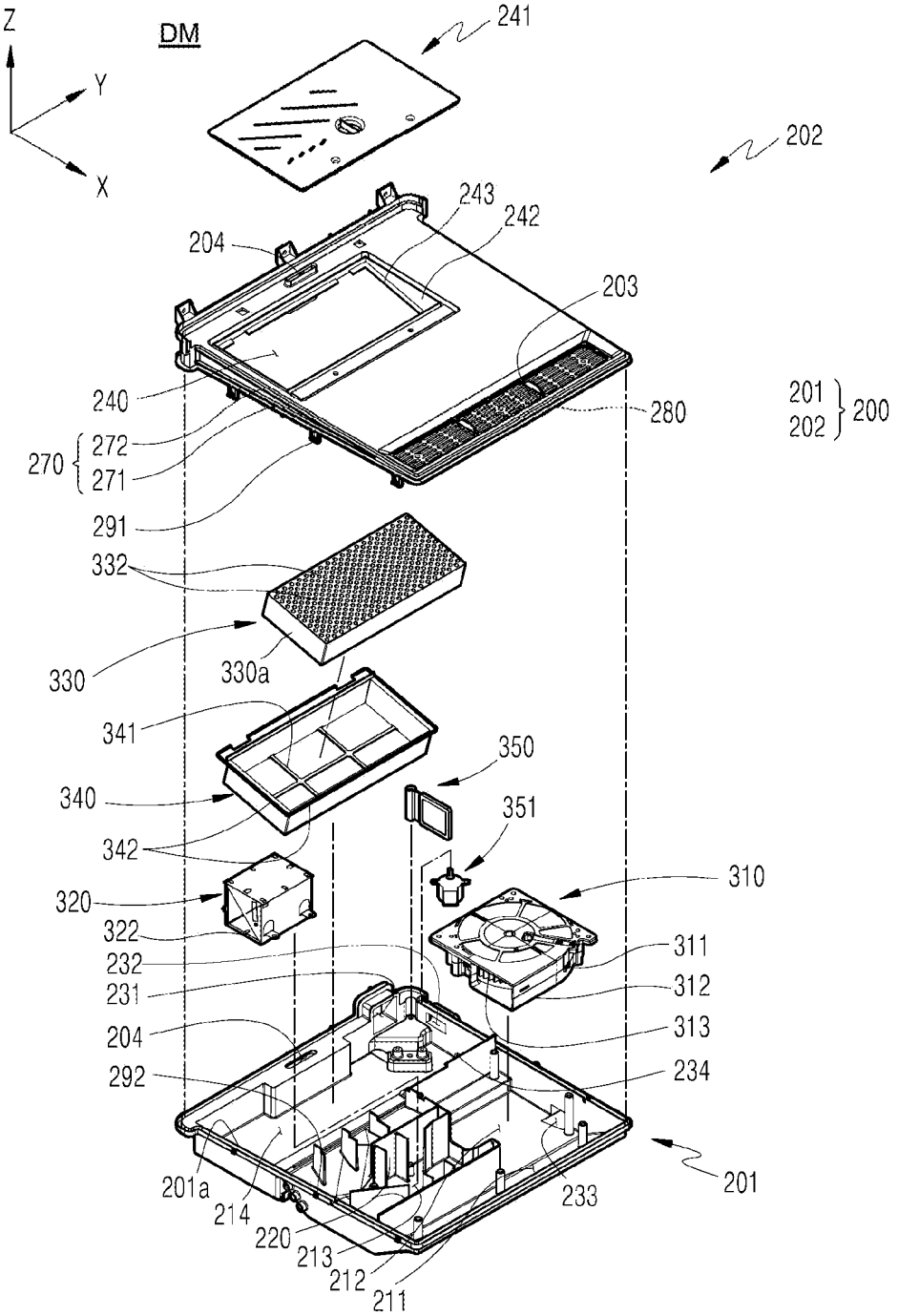
FIG. 10*a* is an exploded perspective view illustrating a drying module in the shoes care device according to one embodiment of the present invention.
Figure 10B:
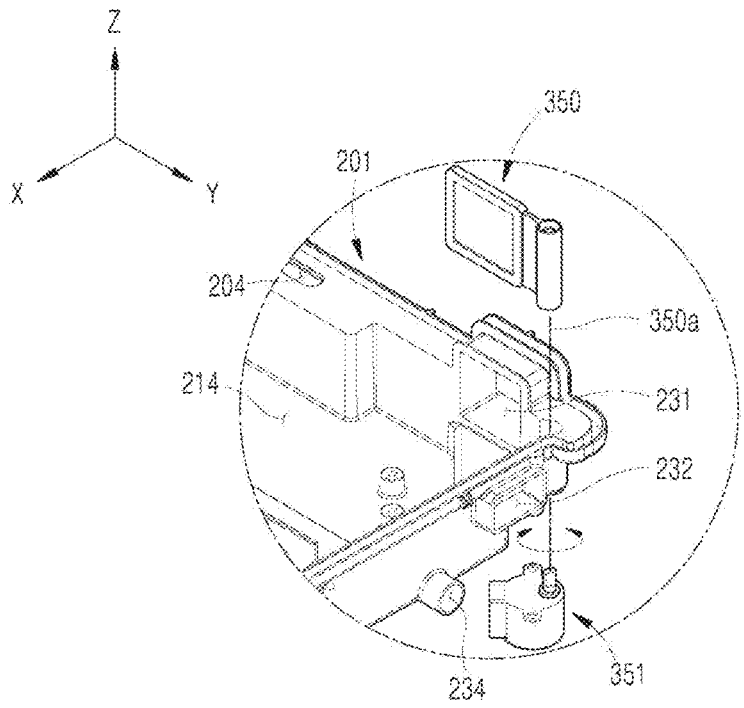
FIG. 10*b* is an exploded perspective view illustrating a partial configuration of the drying module at a part to which a damper is coupled.

FIG. 10*a* is an exploded perspective view illustrating a drying module in the shoes care device 1 according to one embodiment of the present invention. FIG. 10*b* is an exploded perspective view illustrating a partial configuration of the drying module at a part to which the damper 350 is coupled.

In the shoes care device 1 according to one embodiment of the present invention, the dehumidifying part 330 may be used as a means that dehumidifies air.

As described above, the dehumidifying part 330 may be provided inside the module housing 200.

The dehumidifying part 330 is configured to have a predetermined volume. The dehumidifying part 330 may be configured to be porous by itself. A plurality of pores may be formed over an entire volume of the dehumidifying part 330, and air may move by penetrating the dehumidifying part 330 through such pores.

When the dehumidifying part 330 is composed of a combination of a plurality of dehumidifying materials, the plurality of dehumidifying materials may be fixed to each other by a separate fixing means, or may be fixed to each other by adhesion.

The dehumidifying part 330 may be formed of dehumidifying materials, and may be configured to include the dehumidifying materials.

The dehumidifying material 331 according to one embodiment of the present invention is configured to include a material capable of reducing humidity by absorbing moisture in the air. The dehumidifying material 331 may be formed of various materials or a combination of the materials within the range of absorbing or adhering the moisture in the air, and may be formed in various shapes and structures.

The dehumidifying material 331 according to one embodiment of the present invention may be referred to as a desiccant or an adsorbent.

The dehumidifying material 331 according to one embodiment of the present invention may be formed of a microporous material. The dehumidifying material 331 according to one embodiment of the present invention may include silica gel, activated carbon, activated alumina (AL2O3), diatomaceous earth, etc.

Specifically, the dehumidifying material 331 according to one embodiment of the present invention may be formed of zeolite or may be configured to include zeolite.

The zeolite is a natural and synthetic silicate mineral in which tunnels or open channels having a size of approximately 3 to 10 angstroms (Å) are regularly arranged, and may function as dehumidification by adsorbing the moisture in the air.

When the zeolite is heated, moisture adsorbed on the zeolite may be separated into a large amount of steam. According to the characteristics of the zeolite, the zeolite may be regenerated in a state capable of not only performing the dehumidification function to remove the moisture from the air but also performing the dehumidification function by heating the zeolite and separating the moisture adsorbed to the zeolite.

The zeolite may be formed in the form of small grains (or stones) having the size (diameter) of several micrometers to several tens of micrometers, and the dehumidifying material 331 described in one embodiment of the present invention may refer to a combination of the grains (or stones). Each of the grains (or stones) may be agglomerated or combined with each other to form a single structure.

In another embodiment, the dehumidifying part 330 may include a dehumidifying body 330*a* and the dehumidifying material 331.

The dehumidifying body 330*a* may be formed to have a predetermined volume. In one embodiment, the dehumidifying body 330*a* may be formed in a substantially hexahedral shape.

In order to allow air to move through the dehumidifying body 330*a*, the dehumidifying body 330*a* may be provided with a plurality of dehumidification through holes 332 penetrated in one direction. A cross section of the dehumidifying through hole 332 may be formed in a circular shape, a polygonal shape, etc. The dehumidifying through hole 332 may have a hexagonal cross section.

In the dehumidifying body 330*a*, the dehumidifying through hole 332 may all have the same shape and size, or may have different shapes and sizes.

The dehumidifying body 330*a* may be formed of or include materials such as synthetic resin, metal, ceramic, etc. The dehumidifying body 330*a* may be formed of a combination of fibers, and may be formed of a nonwoven fabric, etc.

The dehumidifying material 331 may be coated on the dehumidifying body 330*a*. The dehumidifying material 331 may be coated on the outside and inside of the dehumidifying body 330*a*. Specifically, the dehumidifying material 331 may be coated on a surface in which the dehumidifying through hole 332 is formed.

When the dehumidifying body 330*a* is formed of a combination of fibers, the zeolite may be first coated on each fiber as the dehumidifying material 331, and the zeolite-coated fiber may be processed to form the dehumidifying body 330*a* and simultaneously form the dehumidifying part 330.

Regarding the coating of the zeolite, a manufacturing method of a zeolite coated ceramic paper (Korean Patent No. 10-1004826) is known, and Korean Patent No. 10-1173213 and Korean Patent No. 10-0941521 also describes a method of coating zeolite on a surface of a material. The dehumidifying part 330 according to one embodiment of the present invention may be formed by coating the gelled zeolite precursor on the dehumidifying body 330*a* or materials constituting the dehumidifying body 330*a* and then performing heat treatment when the dehumidifying material 331 is formed of the zeolite.

In one embodiment of the present invention, the coating of the dehumidifying material 331 (zeolite) may be performed by using various known or possible methods, and is not limited to a certain manufacturing method related to the coating of the dehumidifying material 331.

The blowing part 310 is provided inside the connection path F10. A blowing fan 313 may be provided inside the blowing part 310. Since the blowing part 310 is provided in the connection path F10, air flows in the connection path F10 when the blowing part 310 is driven, and since the connection path F10 also communicates with the accommodation space 101 of the inner cabinet 100, the air flows and moves in the accommodation space 101 by driving the blowing part 310.

In this way, the air may be sucked from the inner cabinet 100 into the connection path F10 by the driving of the blowing part 310 (a rotation of the blowing fan 313), and the air inside the connection path F10 may be ventilated.

In one embodiment, the blowing part 310 is provided inside the module housing 200 forming the connection path F10, and the blowing part 310 is driven to suction the air inside the inner cabinet 100 into an inlet 203. The air inside the connection path F10 passes through the module housing 200 constituting the connection path F10, the dry air duct 370, and a nozzle duct 810 and is then discharged back into the inner cabinet 820.

As such, the flow of air may be generated in the shoes care device 1 by the driving of the blowing part 310.

Dry air may be supplied to the inside of the inner cabinet 100 by the blowing part 310.

The heating part 320 is provided at one side of the dehumidifying part 330 and the blowing part 310 in the connection path F10. The heating part 320 may be provided inside the module housing 200. Based on a movement direction of the air inside the module housing 200, the module housing 200 may be arranged in an order of the blowing part 310, the heating part 320, and the dehumidifying part 330. That is, the air introduced into the outlet 203 of the module housing 200 moves along the connection path F10 by passing sequentially through the blowing part 310, the heating part 320, and the dehumidifying part 330.

The heating part 320 is disposed inside the module housing 200 and is configured to heat the air of the module chamber 210 inside the module housing 200.

The heating part 320 may be configured to heat the dehumidifying part 330. The heating part 320 may be configured to heat the dehumidifying material 331 constituting the dehumidifying part 330.

The air heated by the heating part 320 by the driving of the blowing part 310 moves directly to the dehumidifying part 330, thus heating the dehumidifying part 330. To this end, the heating part 320 is disposed inside the module housing 200 adjacent to the dehumidifying part 330. Specifically, the heating part 320 is disposed inside the module housing 200 adjacent to the dehumidifying part 330 based on a movement path of the air inside the module housing 200.

In the module housing 200, the dehumidification by the dehumidifying material 331 or the regeneration of the dehumidifying material 331 may be achieved by selectively heating the heating part 320.

The heating part 320 may be fixedly coupled to the module housing 200 in the module housing 200.

The heating part 320 may be made up of various devices and structures within a range capable of heating the air inside the module housing 200 or supplying heat to the dehumidifying part 330.

The heating part 320 may be formed of an electric heater 321. In one embodiment of the present invention, the heating part 320 may include the heater 321. The heater 321 includes a heating element, and may be configured to supply heat to the periphery while the heating element generates heat by supplied electric energy. The heater 321 may include a nichrome wire as the heating element.

The heater 321 of the heating part 320 may be formed in a ring shape, and the air may move by penetrating the center and surroundings of the ring-shaped heater 321 and be simultaneously heated. The heater 321 of the heating part 320 may be repeatedly formed in a second module chamber 213 along the movement direction of air.

The heater 321 of the heating part 320 may be formed in a circular ring shape or a rectangular ring shape.

The heating part 320 may include a heater flange 322 to which the heater 321 is fixed. The heater flange 322 may be formed in the form of a metallic plate.

The heater flange 322 may be formed of a combination of flat plates in the second module chamber 213 along the movement direction of air. The heater flange 322 has a cross section that may be formed of a plate shape or a combination of plates in the second module chamber 213 along the movement direction of air (the second direction (Y direction)).

The heater flange 322 may include an outer flange 322*a* and an inner flange 322*b*.

The outer flange 322*a* may be formed in a tubular shape along the second direction (Y direction). An interior of the outer flange 322*a* is provided with a space to move air along the movement direction of air (a direction parallel to the second direction (Y direction)) in the second module chamber 213.

The inner flange 322*b* is fixed to the interior of the outer flange 322*a*. The inner flange 322*b* may include two or more plates crossing each other, and the heater 321 of the heating part 320 may be fixed to the inner flange 322*b*.

The heater flange 322 may be formed in various forms that fix the heater 321 of the heating part 320 and do not interfere with a flow of air moving through the second module chamber 213.

In one embodiment of the present invention, the blowing part 310, the heating part 320, the dehumidifying part 330, and the module housing 200 may form one set.

The set may be provided in a plural form. The shoes care device 1 according to one embodiment may be provided with two sets.

Such a set may be provided in each of the first management device 2*a* and the second management device 2*b*.

Such a set may form a drying module DM in the shoes care device 1 according to one embodiment of the present invention.

That is, in one embodiment of the present invention, the drying module DM may include the module housing 200, the blowing part 310, the heating part 320, and the dehumidifying part 330. Furthermore, the drying module DM is provided in each of the first management device 2*a* and the second management device 2*b*.

In the shoes care device 1 according to one embodiment of the present invention, a plurality of drying modules DM may be provided.

In the shoes care device 1 according to one embodiment of the present invention, a pair of drying modules DM may be provided. When the shoes care device 1 is provided with the pair of drying modules DM, one of the drying modules DM may form a 'drying module A (DM1)' as a drying module of the first management device 2*a*, and the other may form a 'drying module B (DM2)' as a drying module of the second management device 2*b*.

The 'drying module' described in one embodiment of the present invention may be understood to refer to each of the 'drying module A' and the 'drying module B' except as otherwise particularly limited.

In the shoes care device 1 according to one embodiment of the present invention, the drying module A (DM1) and the drying module B (DM2) may operate in different modes. When the drying module A (DM1) operates in a moisture absorption mode, the drying module B (DM2) may operate in a regeneration mode. Conversely, when the drying module A (DM1) operates in the regeneration mode, the drying module B (DM2) may operate in the moisture absorption mode.

The 'moisture absorption mode' described in the present invention means a case in which the dehumidifying part 330 adsorbs moisture in the air, and the 'regeneration mode' means a case in which the moisture adsorbed to the dehumidifying part 330 is separated by heating the dehumidifying part 330.

Naturally, both the drying module A (DM1) and the drying module B (DM2) may operate in the moisture absorption mode or may operate in the regeneration mode.

The module housing 200 may be fixedly coupled to a lower side of the inner cabinet 100. The module housing 200 may be detachably coupled to a lower side of the inner cabinet 100.

The module housing 200 includes the module chamber 210 that is a space having other components accommodated inside. That is, the module chamber 210 is a space inside the module housing 200 distinguished from an external space of the module housing 200. As described above, the module housing 200 forms part of the connection path F10, and accordingly, the module chamber 210 is configured to communicate with a space outside the module housing 200. The module chamber 210 communicates with the accommodation space 101 of the inner cabinet 100.

The module housing 200 may include a module case 201 and a module cover 202.

The module case 201 and the module cover 202 may be formed by injection molding, respectively, and may be assembled with each other after manufacturing to form the module housing 200.

The module case 201 is formed in the form of a container that is concave substantially downwards, and forms the module chamber 210 of the module housing 200.

The module case 201 may be configured in the form of a container opened upwards, and includes a module opening 201*a*.

In a plan view, an area of the module opening 201*a* may be larger than or equal to an area of the module chamber 210.

The module chamber 210 may include a first module chamber 212, a second module chamber 213, and a third module chamber 214. The module chamber 210 may include a suction module chamber 211.

In order to distinguish between the suction module chamber 211, the first module chamber 212, the second module chamber 213, and the third module chamber 214, a module partition wall 220 may be formed inside the module housing 200. Furthermore, the module partition wall 220 guides the movement of air so that air moves in a predetermined direction inside the module housing 200.

The suction module chamber 211 is a first space where air is introduced into the module housing 200.

The first module chamber 212 is a space in which the blowing part 310 is accommodated, the second module chamber 213 is a space in which the heating part 320 is accommodated, and the third module chamber 214 is a space in which the dehumidifying part 330 is accommodated.

In one embodiment of the present invention, the suction module chamber 211, the first module chamber 212, the second module chamber 213, and the third module chamber 214 may be formed at different positions in a plan view.

In addition, the air of the module chamber 210 may be configured to move through the suction module chamber 211, the first module chamber 212, the second module chamber 213, and the third module chamber 214 sequentially. That is, when the blowing part 310 is driven, air moves sequentially through the suction module chamber 211, the first module chamber 212, the second module chamber 213, and the third module chamber 214 inside the module housing 200.

The module case 201 may include a dry air outlet 231 and a wet air outlet 232.

The dry air outlet 231 may be formed in a hole shape opened to allow air in the third module chamber 214 to flow out. The dry air outlet 231 is formed adjacent to the third module chamber 214. The dry air outlet 231 may be formed on one edge of the module case 201. Furthermore, the dry air outlet 231 may be connected to the accommodation space 101 through the dry air duct 370 and the nozzle duct 810.

The wet air outlet 232 may be formed in a hole shape opened to allow the air in the third module chamber 214 to flow out. The wet air outlet 232 is formed adjacent to the third module chamber 214. The wet air outlet 232 may be formed on a frame on one side of the module case 201. Furthermore, the wet air outlet 232 may be connected to the condenser 400.

The dry air outlet 231 and the wet air outlet 232 may be formed adjacent to each other. The dry air outlet 231 and the wet air outlet 232 may be formed adjacent to any one vertex part of the module housing 200.

The suction module chamber 211 is formed adjacent to the first module chamber 212, and a bottom surface of the suction module chamber 211 may be inclined downwardly toward the first module chamber 212. Accordingly, air introduced into the suction module chamber 211 may naturally move toward the first module chamber 212 by hitting the bottom surface of the suction module chamber 211 forming an inclined surface, and a condensed water introduced into the suction module chamber 211 may move along the bottom surface of the suction module chamber 211 forming the inclined surface, and may move to the first module chamber 212.

The blowing part 310 may be assembled to the module housing 200 while being spaced apart from a bottom surface of the first module chamber 212. Furthermore, in this case, the blowing part 310 may be configured such that air may be introduced from a lower side of the first module chamber 212 to an interior of the blowing part 310 inside the first module chamber 212.

The module case 201 may include a first condensed water discharge hole 233.

The first condensed water discharge hole 233 is formed in a hole shape penetrating the module case 201. The first condensed water discharge hole 233 is formed on an edge of the module case 201 adjacent to a condenser 400 and formed to be equal to or lower than the bottom surface of the first module chamber 212, and communicates with the condenser 400. Among the bottom surfaces of the first module chamber 212, the first condensed water discharge hole 233 may form the lowest part, or the bottom surface of the first module chamber 212 may be formed such that a height thereof is lowered toward or at least equal to the first condensed water discharge hole 233.

As such, the first condensed water discharge hole 233 may be lower than the bottom surface of the first module chamber 212, and accordingly, the condensed water introduced into the first condensed water discharge hole 232 may move toward the first condensed water discharge hole 233 and flow into the condenser 400 through the first condensed water discharge hole 233.

Meanwhile, since the first condensed water discharge hole 233 is a hole in which the module housing 200 and the condenser 400 communicate with each other, the air inside the condenser 400 may flow into the module housing 200 through the first condensed water discharge hole 233. The air introduced into the module housing 200 through the first condensed water discharge hole 233 from an interior of the condenser 400 may move along the first module chamber 212, the second module chamber 213, and the third module chamber 214 by an operation of the blowing part 310 and may be introduced again into the condenser 400 and condensed.

The shoes care device 1 according to one embodiment of the present invention includes the condenser 400 coupled to an outer surface of the inner cabinet 100 and forming a regeneration path F20. In a plan view, the first module chamber 212 may be provided between the second module chamber 213 and the condenser 400. Since the first module chamber 212 is disposed between the second module chamber 213 and the condenser 400, a direct heat exchange between the condenser 400 and the heating part 320 is blocked, and the heat may be prevented from being transferred to the condenser 400 when the heating part 320 is heated inside the second module chamber 213.

Accordingly, when the dehumidifying part 330 is regenerated, condensation depending on heating of air by the heater 321 of the heating part 320 and cooling of air inside the condenser 400 may be effective performed.

The dehumidifying part 330 may be coupled to the module housing 200 while being spaced apart from a bottom surface of the third module chamber 214. Furthermore, in this case, the air inside the third module chamber 214 may move downwards through the dehumidifying part 330 from an upper side of the third module chamber 214.

The module case 201 may include a second condensed water discharge hole 234.

The second condensed water discharge hole 234 is formed in a hole shape penetrating the module case 201. The second condensed water discharge hole 234 is formed on the edge of the module case 201 adjacent to the condenser 400 and formed to be equal to or lower than the bottom surface of the third module chamber 214, and communicates with the condenser 400. Among the bottom surfaces of the third module chamber 214, the second condensed water discharge hole 234 may form the lowest part, or the bottom surface of the third module chamber 214 may be formed such that a height thereof is lowered toward or at least equal to the second condensed water discharge hole 234.

The second condensed water discharge hole 234 may be formed adjacent to the wet air outlet 232.

In this way, the second condensed water discharge hole 234 may be lower than the bottom surface of the third module chamber 214, and accordingly, condensed water introduced into the third module chamber 214 may move toward the second condensed water discharge hole 234, and may flow into the condenser 400 through the second condensed water discharge hole 234.

Meanwhile, since the second condensed water discharge hole 234 is a hole in which the module housing 200 and the condenser 400 communicate with each other, the air inside the condenser 400 may flow into the module housing 200 through the second condensed water discharge hole 234. In this way, the air introduced from the interior of the condenser 400 into the module housing 200 through the second condensed water discharge hole 234 moves directly to the wet air outlet 232 by the driving of the blowing part 310, and may be introduced again into the condenser 400 and condensed.

The module housing 200 may include the module cover 202.

The module cover 202 is coupled to the module case 201 while shielding the module opening 201*a* from an upper side of the module case 201. The module cover 202 may be detachably coupled to the module case 201. A plurality of locking projections 292 may protrude from one of the module cover 202 and the module case 201, and a plurality of locking grooves 291 into which the locking projections 292 are inserted and locked may be formed on the other. The locking projections 292 and locking grooves 291 are provided in a plural form, respectively, and may be spaced apart along an edge of the module housing 200 and repeatedly formed.

With the blowing part 310, the heating part 320, and the dehumidifying part 330 accommodated in the module case 201, the module cover 202 may shield the blowing part 310, the heating part 320, and the dehumidifying part 330 and may be coupled to the module case 201.

The shoes care device according to one embodiment of the present invention may be formed in a structure in which the dehumidifying part 330 may be detachable from the module housing 200. The structure of the shoes care device provides an advantage in maintaining and managing the dehumidifying part 330 and the shoes care device 1 on the whole.

On the other hand, the dehumidifying part 330 may be repeatedly used by regeneration, but with the repeated use, the dehumidifying part 330 needs to be replaced.

Considering these descriptions, the shoes care device 1 according to one specific embodiment of the present invention may be configured to separate and replace the dehumidifying part 330.

In one embodiment of the present invention, the module cover 202 of the module housing 200 may form a bottom surface of the inner cabinet 100.

The module cover 202 may form a boundary surface between the inner cabinet 100 and the module housing 200. The module cover 202 may be formed in a substantially rectangular shape.

The module cover 202 may be configured in substantially parallel with the horizontal direction.

Alternatively, the module cover 202 may be inclined to any one side. In one embodiment, an upper surface of the module cover 202 may be inclined downwardly toward the first direction (X direction) (a front side of the shoes care device 1).

In one embodiment of the present invention, the main shelf 40 is mounted in close contact with an upper side surface of the module cover 202, and the main shelf 40 mounted on the upper side surface of the module cover 202 is also configured to be inclined when the upper side surface of the module cover 202 is inclined. In this case, since an upper surface of the main shelf 40 is inclined, water (e.g., condensed water) placed on the upper surface of the main shelf 40 may flow along an inclined direction.

The shoes care device 1 may include a dehumidifying material cover 241.

The dehumidifying material cover 241 forms part of the module cover 202 that is the bottom of the inner cabinet 100. Furthermore, the dehumidifying material cover 241 may be detached from the module cover 202 of the inner cabinet 100 or may be hinge-coupled to the module cover 202.

In the module cover 202, a dehumidifying material exit 240 which is an opening of a shape and a size corresponding to the dehumidifying material cover 241 may be formed. The dehumidifying material cover 241 may be configured to open and close the dehumidifying material exit 240. The dehumidifying material cover 241 may be tightly coupled to the dehumidifying material exit 240. At least a part of the dehumidifying material cover 241 may be separated from the module cover 202. In one embodiment, the dehumidifying material exit 240 of the module cover 202 may be opened while completely separating the dehumidifying material cover 241 from the module cover 202, and in another embodiment, the dehumidifying material cover 241 of the module cover 202 may be opened while rotating the dehumidifying material cover 241 around a hinge axis. The dehumidifying part 330 may be introduced into or withdrawn from the module housing 200 through the dehumidifying material exit 240.

The dehumidifying material exit 240 and the dehumidifying material cover 241 may be formed in a position corresponding to the third module chamber 214 in a plan view. That is, the dehumidifying material exit 240 and the dehumidifying material cover 241 may be formed directly above the third module chamber 214. The shoes care device 1 according to one embodiment of the present invention may be configured such that the first module chamber 212 and the second module chamber 213 are not exposed in a plan view in a state where the dehumidifier cover 241 is opened.

When the dehumidifying material cover 241 is opened in the module cover 202, the third module chamber 214 disposed on a lower part of the module cover 202 is exposed through the dehumidifying material exit 240 of the module cover 202, and the dehumidifying part 330 may be settled inside the module case 201, or may be immediately withdrawn and separated from the module case 201.

The sizes and shapes of the dehumidifying material cover 241 and the dehumidifying material exit 240 are variously provided within the range capable of withdrawing or inserting the dehumidifying part 330.

The dehumidifying material cover 241 may be formed in a rectangular plate shape.

The length of the dehumidifying material cover 241 in the first direction (X direction) may be equal to or longer than the length of the dehumidifying part 330, and the length of the dehumidifying material cover 241 in the second direction (Y direction) may be equal to or longer than the length of the dehumidifying part 330.

As described above, in the shoes care device 1 according to one embodiment of the present invention, the heating part 320 and the dehumidifying part 330 are formed at different positions in a top plane view, and when the dehumidifying material cover 241 is opened on the module cover 202 that forms the bottom surface of the inner cabinet 100, the dehumidifying part 330 disposed directly below the dehumidifying material cover 241 may be withdrawn from the module housing 200, and the dehumidifying part 330 may be easily replaced by the user.

In addition, since only the third module chamber 214 is exposed in a state in which the dehumidifier cover 241 is opened, and the first module chamber 212 and the second module chamber 213 are not exposed, the blowing part 310 accommodated in the first module chamber 212 and the heating part 320 accommodated in the second module chamber 213 are not exposed. That is, since the blowing part 310 and the heating part 320 are not directly exposed to the user, safety accidents due to an unintended operation of the blowing part 310 and/or the heating part 320 can be prevented.

The dehumidifying material cover 241 may be configured to separately shield the dehumidifying part 330. A space between the dehumidifying material cover 241 and the dehumidifying part 330 may form a part of the connection path F10.

As described above, the outlet 203 forms an inlet through which the air inside the inner cabinet 100 is sucked into the module housing 200. The outlet 203 may form a start part of the connection path F10. The outlet 203 may be formed in the shape of a hole vertically penetrated from the bottom surface (the upper surface of the module cover 202) of the inner cabinet 100.

A network such as a grid shape, a mesh shape, etc., may be formed on the outlet 203.

The outlet 203 may be formed parallel to the second direction (Y direction). That is, the outlet 203 may be formed in a long hole shape in the module cover 202 along the second direction (Y direction).

The outlet 203 may be formed on an edge of the module cover 202. The outlet 203 may be formed on the edge of the module cover 202 along the second direction (Y direction).

The outlet 203 may be formed on a front part or a rear part of the module cover 202 based on the first direction (X direction).

The outlet 203 may be disposed relatively close to the door 30 in the module cover 202. That is, the outlet 203 may be disposed relatively in the front of the module cover 202.

The upper surface of the module cover 202 may be inclined downwardly toward the outlet 203. That is, a part of the module cover 202 where the outlet 203 is formed may be configured to be the lowest. Accordingly, when water is present on the module cover 202 or the main shelf 40, such water may flow along the surface of the module cover 202 by gravity and flow into the inlet 203.

In the shoes care device 1 according to one embodiment of the present invention, the module chamber 210 is provided inside the module housing 200, and the module chamber 210 includes a first module chamber 212, a second module chamber 213, and the third module chamber 214. The first module chamber 212, the second module chamber 213, and the third module chamber 214 may be formed at different positions in a plan view. That is, the blowing part 310, the heating part 320, and the dehumidifying part 330 may be disposed at different positions in the module housing 200. According to one embodiment of the present invention, the blowing part 310, the heating part 320, and the dehumidifying part 330, which are main means for drying the air inside the inner cabinet 100 and main means for regenerating the dehumidifying part 330, are disposed together in the module chamber 210 of the module housing 200. Accordingly, the blowing part 310, the heating part 320, and the dehumidifying part 330 are disposed at positions considerably close to each other.

In one embodiment of the present invention, the module case 201 of the module housing 200 may be integrally formed by injection molding. In this case, the bottom parts of the module housing 200 may be integrally formed, the bottom parts may not be assembled with each other, and no gaps may be formed in the bottom parts.

In the arrangement explained above, the condensed water can be effectively prevented from leaking from the module housing 200. In addition, a vertical height of the module housing 200 can be minimized.

When moisture remains at an unintended part inside the shoes care device 1, such moisture may reproduce bacteria or cause odors. This is why there is need for countermeasures to solve the problems, and the shoes care device 1 according to one embodiment of the present invention can effectively prevent water from leaking in consideration of such problems.

In the shoes care device 1 according to one embodiment of the present invention, the air in the module chamber 210 may sequentially move the first module chamber 212, the second module chamber 213, and the third module chamber 214. Accordingly, since the third module chamber 214 and a drying flow path F10*b* may be connected in the shortest distance, which provides excellent drying efficiency by the dehumidifying part 330, and air heated by the heating part 320 moves directly to the dehumidifying part 330 to form the shoes care device 1 with excellent regeneration efficiency.

In the shoes care device 1 according to one embodiment of the present invention, the module housing 200 includes the suction module chamber 211, and the bottom surface of the suction module chamber 211 may be inclined downwardly toward the first module chamber 212. Accordingly, the air introduced through the outlet 203 moves naturally to the first module chamber 212 by hitting the bottom surface of the suction module chamber 211, and the condensed water introduced into the outlet 203 moves to the first module chamber 212 such that the condensed water can be easily drained.

The shoes care device 1 according to one embodiment of the present invention may include the condenser 400, and the module case 201 may include the first condensed water discharge hole 233. In addition, the module case 201 may include the second condensed water discharge hole 234. Accordingly, the dehumidifying part 330 may be effectively regenerated, and condensed water inside the module housing 200 may be easily discharged to the condenser 400.

In the shoes care device 1 according to one embodiment of the present invention, steam generated by the steam generator 700 is supplied to the accommodation space 101 of the inner cabinet 100, and to this end, the shoes care device 1 includes a steam inlet 204.

The steam inlet 204 forms an inlet through which steam is supplied to the accommodation space 101 of the inner cabinet 100.

In the shoes care device according to one embodiment of the present invention, the steam inlet 204 is formed in the module housing 200.

The steam inlet 204 may be formed in a rear part of the module housing 200 based on the first direction (X direction). The steam inlet 204 may be formed to vertically penetrate the module housing 200. The steam inlet 204 may be formed to vertically penetrate the module case 201 and the module cover 202. The steam inlet 204 may be formed in the center in a right-left direction at the rear part of the module housing 200.

The steam inlet 204 may be formed on a rear edge of the module housing 200, and may be formed directly behind a position where the third module chamber 214 is formed. The third module chamber 214 and the steam inlet 204 are shielded from each other.

In the module housing 200, the module cover 202 forms the bottom surface of the accommodation space 101, and when the module housing 200 is coupled to the inner cabinet 100, the steam inlet 204 is formed behind the bottom of the inner cabinet 100.

The steam generator 700 and the steam valve 710 are disposed in a lower part, the distance from the steam generator 710 to the steam inlet 204 can be reduced by forming the module housing 200, and the steam inlet 204 in a rear part of the module housing 200, and an increase in the load required for the supply of steam can be prevented. Accordingly, steam may be smoothly supplied from the steam generator 700 to the steam inlet 204.

Figure 11:
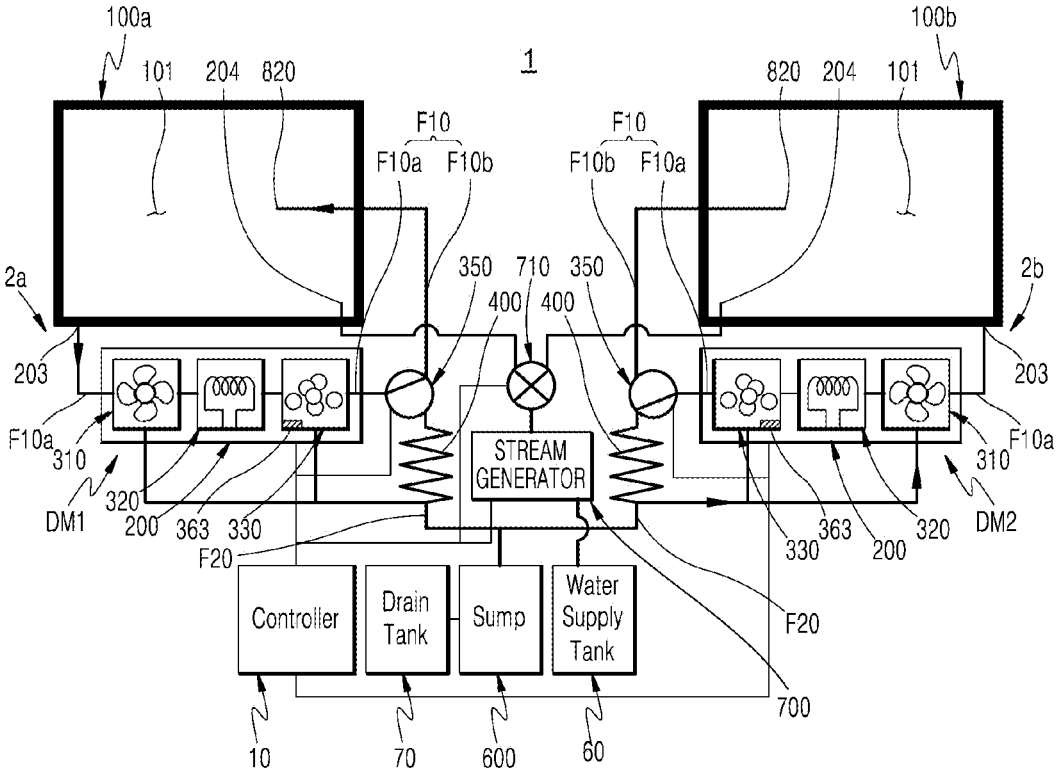
FIG. 11 is a diagram illustrating a connection relationship between components and a flow of fluid in the shoes care device according to one embodiment of the present invention.

FIG. 11 is a diagram illustrating a connection relationship between components and a flow of fluid in the shoes care device 1 according to one embodiment of the present invention.

The connection path F10 forms a movement path of air connected from the outlet 203 to the nozzle 820. That is, the outlet 203 may form an inlet of the connection path F10, and the nozzle 820 may form an outlet of the connection path F10.

The outlet 203 may be coupled to communicate with the inner cabinet 100, and the nozzle 820 may be provided inside the inner cabinet 100. Except the outlet 203 and the nozzle 820, one part of the connection path F10 may be provided inside the inner cabinet 100, and the other part may be provided outside the inner cabinet 100.

The air inside the inner cabinet 100 moves to the connection path F10 through the outlet 203, and the air passing through the connection path F10 moves back into the inner cabinet 100 through the nozzle 820. As such air flow is repeated, the air circulation is performed in the shoes care device 1.

In the nozzle 820, a hole through which air is discharged is formed in the accommodation space 101 of the inner cabinet 100, and the nozzle 820 may form a last part of the connection path F10.

In the shoes care device 1 according to one embodiment of the present invention, since the nozzle 820 is configured to be movable to various positions inside the inner cabinet 100, the shoes may be managed in various positions.

As described above, the dehumidifying part 330 is disposed in the connection path F10. The air moving through the connection path F10 passes through the dehumidifying part 330, and the dehumidifying part 330 absorbs moisture from the air moving through the connection path F10 such that the air from which moisture has been removed may be supplied into the inner cabinet 100.

The connection path F10 may be divided into a conversion flow path F10*a* and a drying flow path F10*b*. The conversion flow path F10*a* and the drying flow path F10*b* form a movement path of air sequentially connected to each other. The air in the connection path F10 may sequentially move through the conversion flow path F10*a* and the drying flow path F10*b*.

The conversion flow path F10*a* forms an upstream section of the connection path F10, which is connected to the outlet 203. The conversion flow path F10*a* may be a section in which the blowing part 310, the heating part 320, and the dehumidifying part 330 are disposed. The conversion flow path F10*a* may be formed by the module housing 200, and the module chamber 210 inside the module housing 200 may form the conversion flow path F10*a*.

The conversion flow path F10*a* may be a section in which humid air moves and dries. The conversion flow path F10*a* may be a section in which air is dehumidified by the dehumidifying part 330.

Meanwhile, the conversion flow path F10*a* may be a section in which the dehumidifying part 330 (the dehumidifying material 331) are regenerated.

The drying flow path F10*b* forms a downstream section of the connection path F10, which connects the conversion flow path F10*a* to the nozzle 820. A flow path formed by the drying air duct 370, the nozzle duct 810, and the nozzle 820 may form the drying flow path F10*b*.

The drying passage F10*b* may be a section in which dry air with moisture removed therefrom moves.

When the drying module DM operates in the moisture absorption mode, the drying flow path F10*b* communicates with the conversion flow path F10*a*, and when the drying module DM operates in the regeneration mode, the drying flow path F10*b* and the conversion flow path F10*a* may not communicate with each other such that the drying flow path F10*b* and the conversion flow path F10*a* block each other.

Accordingly, when air is dehumidified by the dehumidifying part 330 in the conversion flow path F10*a*, the dried air moves through the drying flow path F10*b*.

The dry air duct 370 may be fixedly coupled to an outer wall surface of the inner cabinet 100, and the nozzle duct 810 may be provided inside the inner cabinet 100.

As the dry air duct 370 is tightly coupled to an inner rear plate 110 of the inner cabinet 100, a flow path may be formed between the dry air duct 370 and the inner cabinet 100 (the inner rear plate 110), and such a flow path may form a part of the drying flow path F10*b*. A lower part of the dry air duct 370 communicates with the dry air outlet 231 of the module housing 200, an upper part thereof communicates with the nozzle duct 810, which connect the interior of the module housing 200 and the interior of the nozzle duct 810 for mutual communication.

As described above, after humid air in the accommodation space 101 of the inner cabinet 100 flows into the conversion flow path F10*a*, the air is dehumidified by the dehumidifying part 330 and converted into dry air, and the dry air can be resupplied to the accommodation space 101 of the inner cabinet 100 through the drying flow path F10*b*.

The regeneration path F20 forms a movement path of a fluid.

The regeneration path F20 forms a passage through which air and/or condensed water inside the shoes care device moves.

The regeneration path F20 forms a path through which air and/or condensed water passing through the dehumidifying part 330 moves when the dehumidifying material 331 is regenerated. The regeneration path F20 may be entirely or partially formed of a pipe, a hose, a tube, a duct, a housing, or a combination thereof.

Moisture generated during the regeneration process of the dehumidifying material 331 needs to be discharged through a separate flow path separated from the drying flow path F10*b*, which is a flow path through which dry air moves. Accordingly, the shoes care device 1 according to one embodiment of the present invention includes the regeneration path F20, and when the dehumidifying material 331 is regenerated, air passing through the dehumidifying part 330 is not ventilated to the nozzle 820 but moves through the regeneration path F20.

The regeneration path F20 is a flow path branched from the connection path F10. The regeneration path F20 may be branched from the connection path F10 to form a path different from that of the drying flow path F10*b* of the connection path F10. The regeneration path F20 is connected to the sump 600.

The regeneration path F20 may be a section that connects the conversion flow path F10*a* and the sump 600.

The regeneration path F20 may be a section in which humid air separated from the dehumidifying part 330 moves.

The condenser 400 according to one embodiment of the present invention forms a regeneration path F20. Moisture separated from the dehumidifying material 331 may be condensed after moving to the condenser 400 along with air moving along the regeneration path F20. In addition, condensed water condensed in the condenser 400 may be moved to the sump 600 through the regeneration path F20, collected from a lower part of the sump 600, and then discharged to the drain tank 70, discharged to the outside, or pressed to the steam generator 700.

In the shoes care device 1 according to one embodiment of the present invention, when the drying module DM operates in the regeneration mode, the regeneration path F20 communicates with the conversion flow path F10*a*, and when the drying module DM operates in the moisture absorption mode, the regeneration path F20 and the conversion flow path F10 may not communicate with each other such that the regeneration path F20 and the conversion flow path F10 block each other.

Accordingly, when the dehumidifying part 330 is regenerated in the conversion flow path F10*a*, humid air containing moisture separated from the dehumidifying part 330 moves through the regeneration path F20.

In one embodiment of the present invention, the damper 350 may be formed in the form of a damper valve.

The damper 350 may be rotatably coupled to the module housing 200. The damper 350 may be coupled to the module housing 200 in a form accommodated in the module housing 200.

As described above, in the module housing 200, the dry air outlet 231 forming an inlet of the drying flow path F10*b* is formed as a passage of the connection path F10, and the wet air outlet 232 forming an inlet of the regeneration path F20 is formed.

The damper 350 controls a movement path of air passing through the dehumidifying material 331 in the module housing 200. Depending on the operation of the damper 350, the air passing through the dehumidifying material 331 may move into the inner cabinet 100 through the nozzle 820 or may move into the regeneration path F20.

The damper 350 may be configured to open the regeneration path F20 while blocking the drying flow path F10*b*, or to open the drying flow path F10*b* while blocking the regeneration path F20.

The damper 350 may be configured to selectively shield the dry air outlet 231 and the wet air outlet 232. The damper 350 may be configured to selectively seal the dry air outlet 231 and the wet air outlet 232.

The damper 350 may selectively block one of the dry air outlet 231 and the wet air outlet 232. When the damper 350 opens the dry air outlet 231 while blocking the wet air outlet 232, the air passing through the dehumidifying material 331 may move into the inner cabinet 100 through the nozzle 820, and when the damper 350 opens the wet air outlet 232 while blocking the dry air outlet 231, the air passing through the dehumidifying material 331 may be condensed while moving through the regeneration path F20.

In the shoes care device 1 according to one embodiment of the present invention, the damper 350 may be configured to be hinge-rotatable around a hinge axis 350*a* formed on one side. The hinge axis 350*a* of the damper 350 may be parallel to the third direction (Z direction). In addition, the shoes care device 1 may include a damper motor 351 configured to rotate the damper 350 around the hinge axis 350*a* of the damper 350. The damper motor 351 may be formed as an electric motor and may be configured to rotate the damper 350 bidirectionally.

When the damper 350 opens the dry air outlet 231 and seals the wet air outlet 232, the air inside the inner cabinet 100 moves along the connection path F10 and is circulated by sequentially passing through the inlet 203, the module housing 200 (the blowing part 310 and the dehumidifying part 330, the dry air outlet 231, the dry air duct 370, the nozzle duct 810, and the nozzle 820.

When the damper 350 seals the dry air outlet 231 and opens the wet air outlet 232, the air moves along the conversion flow path F10*a* and the regeneration path F20 and is circulated by sequentially passing through the module housing 200 (the blowing part 310, the heating part 310, and the dehumidifying part 330), the wet air outlet 232, and the condenser 400.

In one embodiment of the present invention, the controller 10 may control the damper motor 351 such that the damper 350 closes the dry air outlet 231 and opens the wet air outlet 232 when the heating part 320 is turned on. In addition, the controller 10 may control the damper motor 351 such that the damper 350 opens the dry air outlet 231 and closes the wet air outlet 232 when the heating part 320 is turned off.

Accordingly, by controlling the damper motor 351 by the controller 10, the damper 350 may open the drying flow path F10*b* and close the regeneration path F20 when the heating part 320 is turned off, and may close the drying flow path F10*b* and open the regeneration path F20 when the heating part 320 is turned on.

The damper motor 351 may be controlled individually in each of the first management device 2*a* and the second management device 2*b*.

Referring to FIG. 11, in the drying module A (DM1) of the first management device 2*a*, the damper 350 seals the wet air outlet 232 and opens the dry air outlet 231 of the second management device 2*b*, and in the drying module B (DM2) of the second management device 2*b*, when the damper 350 opens the wet air outlet 232 and seals the dry air outlet 231, the air in the conversion flow path F10*a* of the first management device 2*a* may flow through the drying flow path F10*b*, and the air in the conversion flow path F10*a* of the second management device 2*b* may flow through the regeneration path F20. Furthermore, in this case, the drying module A (DM1) of the first management device 2*a* may operate in the moisture absorption mode, and the drying module B (DM2) of the second management device 2*b* may operate in the regeneration mode.

In contrast, when in the drying module A (DM1) of the first management device 2*a*, the damper 350 opens the wet air outlet 232 and seals the dry air outlet 231, and in the drying module B (DM2) of the second management device 2*b*, the damper 350 seals the wet air outlet 232 and opens the dry air outlet 231, the air in the conversion flow path F10*a* of the first management device 2*a* may flow along the regeneration path F20, and the air in the conversion flow path F10*a* of the second management device 2*b* may flow along the drying flow path F10*b*. Furthermore, in this case, the drying module A (DM1) of the first management device 2*a* may operate in the regeneration mode, and the drying module B (DM2) of the second management device 2*b* may operate in the moisture absorption mode.

In both the drying module A (DM1) of the first management device 2*a* and the drying module B (DM2) of the second management device 2*b*, when the damper 350 seals the wet air outlet 232 and opens the dry air outlet 231, both the drying module A (DM1) and the drying module B (DM2) may operate in the moisture absorption mode.

In both the drying module A (DM1) of the first management device 2*a* and the drying module B (DM2) of the second management device 2*b*, when the damper 350 seals the dry air outlet 231 and opens the wet air outlet 232, both the drying module A (DM1) and the drying module B (DM2) may operate in the regeneration mode.

In the shoes care device 1 according to one embodiment of the present invention, the first management device 2*a* and the second management device 2*b* individually include the inner cabinet 100, the connection path F10, the blowing part 310, and the dehumidifying part 330. In addition, the shoes care device 1 includes the steam generator 700 and the steam valve 710. Accordingly, the degree of the supply of steam, the degree of dehumidification by the dehumidifying part 330, and the flow of air circulated along the connection path F10 may be different in each of the first management device 2*a* and the second management device 2*b*, and the first management device 2*a* and the second management device 2*b* may manage shoes under different conditions.

In addition, the first management device 2*a* and the second management device 2*b* include the module housing 200, the blowing part 310, the heating part 320, the dehumidifying part 330, and the drying flow path F10*b*, respectively. The air and condensed water moving in the first management device 2*a* and the air and condensed water moving in the second management device 2*b* move along different paths, thereby achieving accurate control intended in each of the first management device 2*a* and the second management device 2*b*. In this case, since the first management device 2*a* and the second management device 2*b* share and use the steam generator 700, the steam generator 700 can be efficiently utilized in the shoes care device 1, and the shoes care device 1 can efficiently utilize the space.

In addition, as described above, when the shoes are dried in one of the first management device 2*a* and the second management device 2*b*, the dehumidifying part 330 may be regenerated in the other, and the efficient management of the shoes and efficient use of the shoes care device 1 can be achieved.

In the shoes care device 1 according to one embodiment of the present invention, the first management device 2*a* and the second management device 2*b* each include the regeneration path F20 and the damper 350 individually.

The controller 10 may control the heating part 320 (the heater 321) and the damper 350 to interwork with each other.

The controller 10 may control the damper 350 to open the drying flow path F10*b* and close the regeneration path F20 when the heating part 320 is turned off, and may control the damper 350 to close the drying flow path F10*b* and open the regeneration path F20 when the heating part 320 is turned on.

The controller 10 may control each component of the shoes care device 1 such that air flowing into the module chamber 210 from the accommodation space 101 and passing through the dehumidifying part 330 moves along the drying flow path F10*b* when the heating part 320 is turned off (when the heater 321 of the heating part 320 is turned off), and the air moves along the regeneration path F20 when the heating part 320 is turned on (when the heater 321 of the heating part 320 is turned on).

Such control may be performed individually in each of the first management device 2*a* and the second management device 2*b*. Accordingly, since the movement path of air inside the module chamber 210 is changed depending on an operation of the heating part 320, the drying of the shoes and the regeneration of the dehumidifying part 330 can be effectively achieved.

The controller 10 may control the steam valve 710 and the heating part 320 to interwork with each other.

The controller 10 may control the steam valve 710 such that when the heating part 320 of the first management device 2*a* is turned off, the valve disk 715 closes or opens the first valve outlet 713, when the heating part 320 of the first management device 2*a* is turned on, the valve disk 715 closes the first valve outlet 713, when the heating part 320 of the second management device 2*b* is turned off, the valve disk 715 closes or opens the second valve outlet 714, and when the heating part 320 of the second management device 2*b* is turned on, the valve disk 715 closes the second valve outlet 714.

In this way, the supply of steam to the accommodation space 101 of the inner cabinet 100 and the operation of the heating part 320 inside the module housing 200 may interwork with each other to effectively perform the drying of the shoes and the regeneration of the dehumidifying part 330.

The shoes care device 1 according to one embodiment of the present invention may include a first sensor 361 and a second sensor 362 (see FIG. 9).

The first sensor 361 may be installed in the second module chamber 213 of the module housing 200, and the second sensor 362 may be installed in the third module chamber 214 of the module housing 200. The first sensor 361 may be configured to measure the temperature and/or humidity of the second module chamber 213, and the second sensor 362 may measure the temperature and/or humidity of the third module chamber 214.

The first sensor 361 measures the temperature and/or humidity of air before passing through the dehumidifying part 330, and the second sensor 362 measures the temperature and/or humidity of air after passing through the dehumidifying part 330.

The controller 10 may compare the temperature and/or humidity of the second module chamber 213 measured by the first sensor 361 with the temperature and/or humidity of the third module chamber 214 measured by the second sensor 362 to recognize a state and a change of the temperature and/or humidity inside the module housing, and may also check an operation state of the drying module DM.

The controller 10 may recognize the temperature and humidity of the second module chamber 213 measured by the first sensor 361, and the temperature and humidity of the third module chamber 214 measured by the second sensor 362 to recognize a change in the humidity inside the module housing 200. Accordingly, the degree of dehumidification by the dehumidifying part 330 may be checked, and the degree of regeneration of the dehumidifying part 330 may be checked.

In one embodiment, when the drying module DM operates in the moisture absorption mode, the controller 10 may control the drying module DM to stop operating in the moisture absorption mode and operate in the regeneration mode if a humidity change amount of the second module chamber 213 recognized by the first sensor 361 and a humidity change amount of the third module chamber 214 recognized by the second sensor 362 is less than or equal to a reference value.

In one embodiment, when the drying module DM operates in the regeneration mode, the controller 10 may control the drying module DM to stop operating in the regeneration mode if the humidity change amount of the second module chamber 213 recognized by the first sensor 361 and the humidity change amount of the third module chamber 214 recognized by the second sensor 362 is less than or equal to the reference value.

The shoes care device 1 according to one embodiment of the present invention further includes a third sensor 363 capable of measuring the amount of moisture adsorbed to the dehumidifying material 331, and the controller 10 may control the drying module DM to operate the regeneration mode until the amount of moisture measured by the third sensor 363 is less than or equal to a set value.

Specifically, the controller 10 may control all the heating parts 320 to operate until the amount of moisture measured by the third sensor 363 is less than or equal to the set value.

In this case, as illustrated in FIG. 11, the third sensor 363 may include a moisture sensor installed adjacent to the dehumidifying material 331 to measure the amount of moisture adsorbed to the dehumidifying material 331, and the type and number thereof may vary as necessary.

In this way, when the moisture adsorbed on the dehumidifying material 331 is sensed to exceed the reference value, the shoes care device 1 according to one embodiment of the present invention first regenerates all dehumidifying materials 331 until the moisture is less than or equal to the reference value. Accordingly, the dehumidifying material 331 can maintain an appropriate state for dehumidification all the time even when the shoes care device 1 operates to refresh the shoes.

Figure 12:
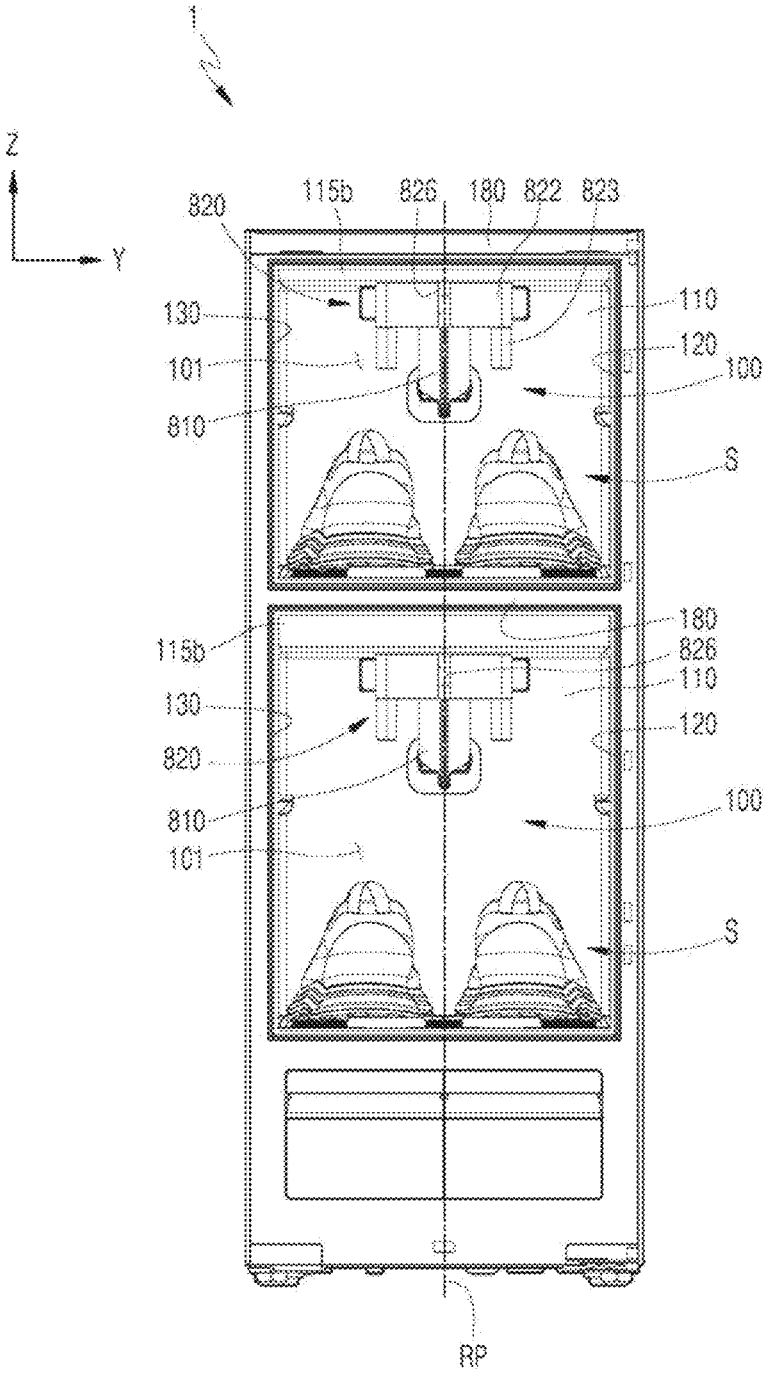
FIG. 12 is a front view illustrating a state in which the door is removed from the shores care device illustrated in FIG. 1*b*.

FIG. 12 is a front view illustrating a state in which the door 30 is removed from the shores care device 1 illustrated in FIG. 1*b*. FIG. 12 illustrates the shoes accommodated in the inner cabinet 100 together.

Figure 13:
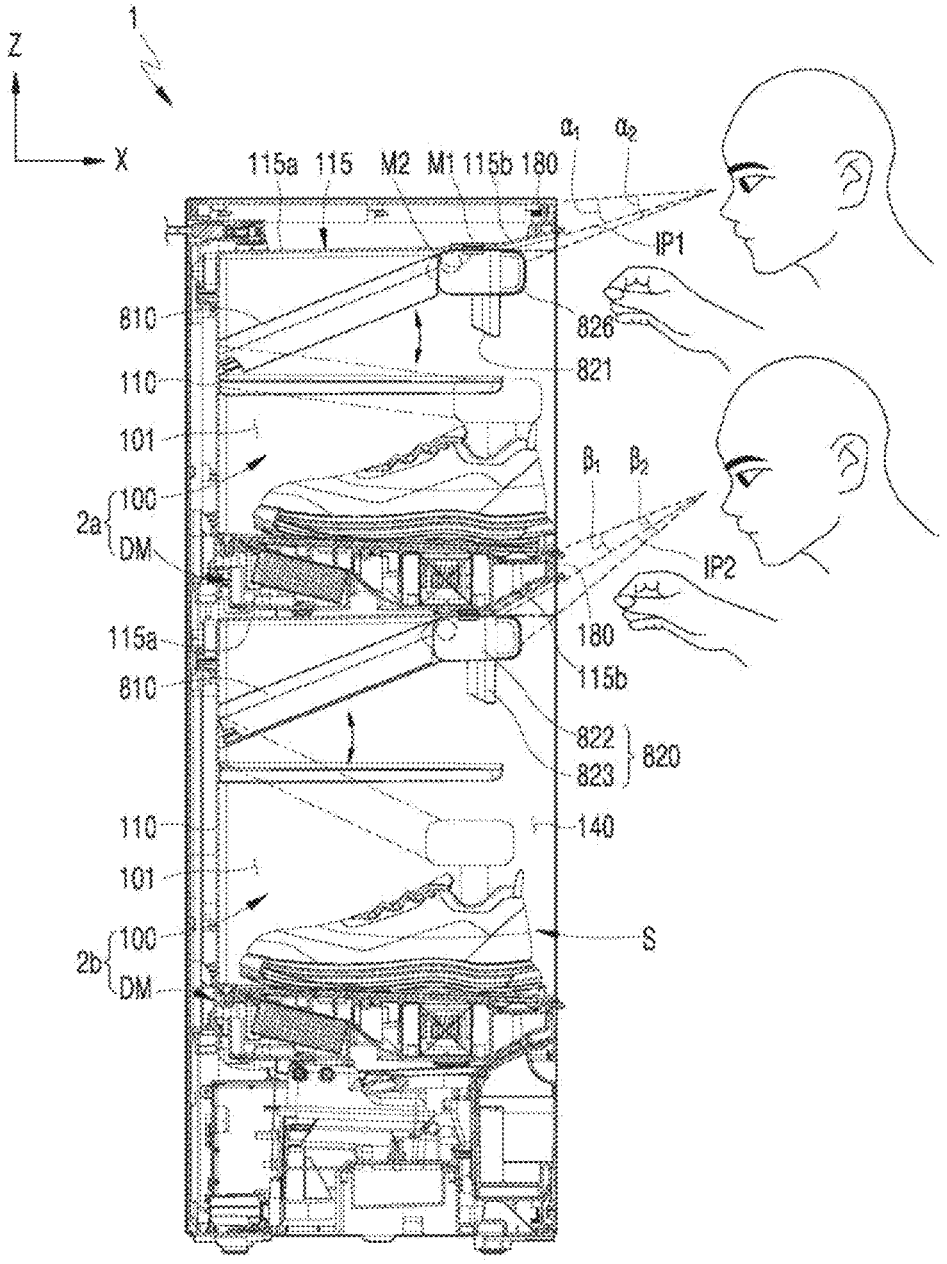
FIG. 13 is a cross-sectional view illustrating a state in which the door is removed from the shores care device illustrated in FIG. 4*c*.

FIG. 13 is a cross-sectional view illustrating a state in which the door 30 is removed from the shores care device 1 illustrated in FIG. 4*c*. FIG. 13 illustrates the shoes accommodated in the inner cabinet 100 together.

The shoes care device 1 according to one embodiment of the present invention may include the inner cabinet 100, the door 30, the nozzle duct 810, the nozzle 820, the nozzle handle 826, and a nozzle connector 830.

The inner cabinet 100 may have an accommodation space 101 formed inside. The shoes S may be accommodated in the accommodation space 101. In addition, the inner cabinet 100 may have a main opening 140 that opens the accommodation space 101 in the first direction (X direction) as the horizontal direction.

In one embodiment, the first direction (X direction) may be a direction from the rear of the shoes care device 1 to the front thereof. The first direction (X direction) may be parallel to a front-rear direction. In addition, it is described that the second direction (Y direction) is parallel to a left-right direction, and the third direction (Z direction) is parallel to the vertical direction.

The inner cabinet 100 may include the inner rear plate 110, the first inner side plate 120, the second inner side plate 130, and the inner upper plate 115. The inner rear plate 110, the first inner side plate 120, the second inner side plate 130, and the inner upper plate 115 may be formed integrally with each other.

The inner rear plate 110 forms a wall surface (border surface) at the rear of the accommodation space 101. That is, the inner rear plate 110 forms a wall surface (border surface) vertically erected at the rear of the accommodation space 101. The inner rear plate 110 may form a surface orthogonal to the first direction (X direction).

The inner upper plate 115 may form a ceiling of the accommodation space 101. The inner upper plate 115 may include the first region 115*a* and the second region 115*b*. The first region 115*a* and the second region 115*b* may be formed integrally with each other.

The inner cabinet 100 may include the front frame 180. The front frame 180 may extend ahead of the inner upper plate 115 with respect to the first direction (X direction). The front frame 180 may form an edge of the main opening 140. The front surface of the front frame 180 may be orthogonal to the first direction (X direction).

The shoes care device 1 according to one embodiment of the present invention includes management devices 2*a* and 2*b*. The management devices 2*a* and 2*b* may include the inner cabinet 100 and the drying module DM. In one embodiment, the shoes care device 1 may include the first management device 2*a* and the second management device 2*b*.

That is, the first management device 2*a* may include the inner cabinet 100 and a drying module DM. Further, the second management device 2*b* may include the inner cabinet 100 and the drying module DM.

The first management device 2*a* and the second management device 2*b* may be provided adjacent to each other. The first management device 2*a* may be disposed above the second management device 2*b*.

Accordingly, the inner cabinet 100 of the first management device 2*a* may be disposed above the inner cabinet 100 of the second management device 2*b*. Each of the front frames 180 may be connected to the inner cabinet 100 of the first management device 2*a* and the inner cabinet 100 of the second management device 2*b*.

Figure 14A:
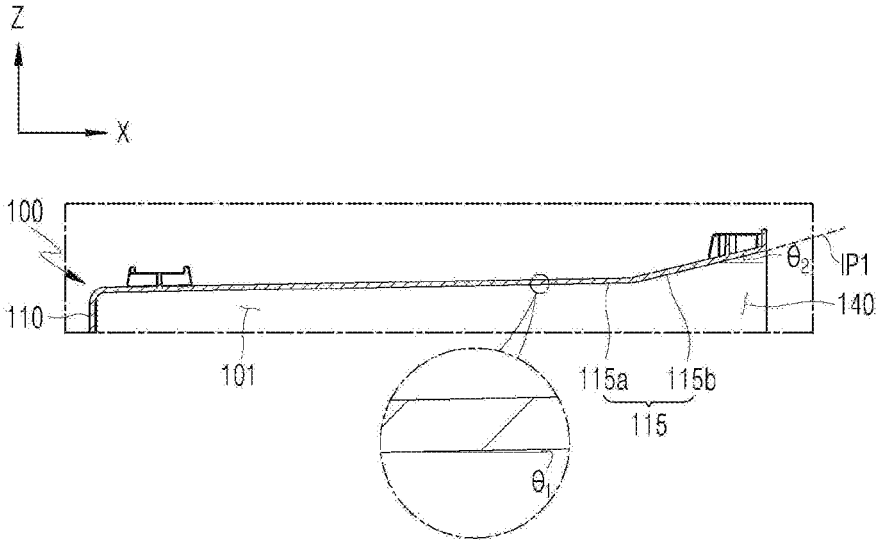
FIG. 14*a* is a cross-sectional view illustrating the inner cabinet according to one embodiment of the present invention and is a cross-sectional view illustrating an inner upper plate of the inner cabinet of a first management device.

FIG. 14*a* is a cross-sectional view illustrating the inner cabinet 100 according to one embodiment of the present invention and is a cross-sectional view illustrating the inner upper plate 115 of the inner cabinet 100 of the first management device 2*a*.

Figure 14B:
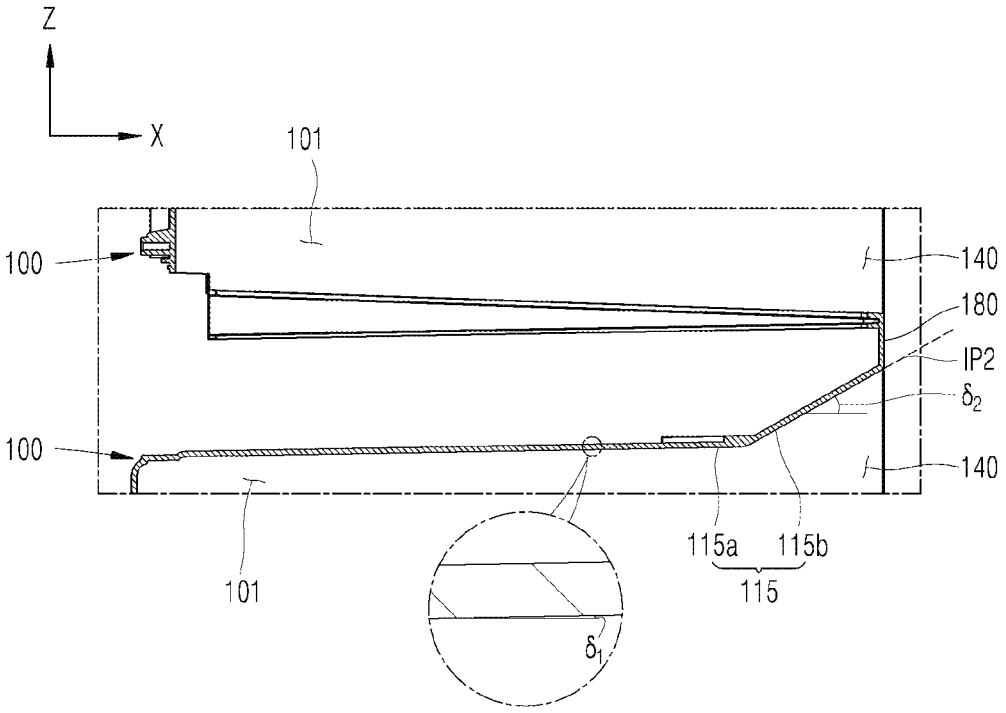
FIG. 14*b* is a cross-sectional view illustrating the inner cabinet according to one embodiment of the present invention and is a cross-sectional view illustrating the inner upper plate of the inner cabinet of a second management device.

FIG. 14*b* is a cross-sectional view illustrating the inner cabinet according to one embodiment of the present invention and is a cross-sectional view illustrating the inner upper plate 115 of the inner cabinet 100 of the second management device 2*b*.

The first region 115*a* refers to a region extending in an upwardly inclined direction from the upper side of the inner rear plate 110. The height of the first region 115*a* may get larger toward the first direction (X direction). An increase of the height of the first region 115*a* per unit distance in the first direction (X direction) may remain constant.

In one embodiment, based on the first direction (X direction), the first region 115*a* of the first management device 2*a* may form a spacing angle θ1 with respect to the horizontal plane.

The inner upper plate 115 of the first management device 2*a* may have a constant thickness in the first region 115*a* based on the first direction (X direction). Accordingly, based on the first management device 2*a*, the bottom surface of the first region 115*a* may form a spacing angle θ1 with respect to the horizontal plane.

In one embodiment, based on the first direction (X direction), the first region 115*a* of the second management device 2*b* may form a spacing angle δ1 with respect to the horizontal plane.

The inner upper plate 115 of the second management device 2*b* may have a constant thickness in the first region 115*a* based on the first direction (X direction). Accordingly, based on the second management device 2*b*, the bottom surface of the first region 115*a* may form a spacing angle δ1 with respect to the horizontal surface.

In one embodiment, θ1 and δ1 may be the same angle. Based on the first direction (X direction), the first region 115*a* of the first management device 2*a* and the first region 115*a* of the second management device 2*b* may form the same length.

The first region 115*a* of the first management device 2*a* may be parallel to the second direction (Y direction). Accordingly, as shown in FIG. 12, when the main opening 140 is viewed from the front of the shoes care device 1 with respect to the first management device 2*a*, the bottom surface of the first area 115*a* may not form a height in the second direction (Y direction).

The first region 115*a* of the second management device 2*b* may be parallel to the second direction (Y direction). Accordingly, as shown in FIG. 12, when the main opening 140 is viewed from the front of the shoes care device 1 with respect to the second management device 2*b*, the bottom surface of the first area 115*a* may not form a height in the second direction (Y direction).

The second region 115*b* refers to a region extending in front of the first region 115*a* based on the first direction (X direction). The second region 115*b* forms an upwardly inclined surface. The height of the second region 115*b* may get larger toward the first direction (X direction). An increase of the height of the second region 115*b* per unit distance in the first direction (X direction) may remain constant.

In one embodiment, based on the first direction (X direction), the second region 115*b* of the first management device 2*a* may form a spacing angle θ2 with respect to horizontal plane.

The inner upper plate 115 of the first management device 2*a* may have a constant thickness in the second region 115*b* based on the first direction (X direction). Accordingly, based on the first management device 2*a*, the bottom surface of the second region 115*b* may form a spacing angle θ2 with respect to the horizontal surface.

The first region 115*a* may be inclined upwards in the first direction (X direction) to become smaller than the inclination angle formed by the second region 115*b*. That is, based on the first direction (X direction), the inclination of the second region 115*b* of the first management device 2*a* may be greater than the inclination of the first region 115*a* of the first management device 2*a*. Accordingly, θ2 may be an angle greater than 01.

As illustrated in FIG. 13, when the user's gaze coincides with a virtual surface (hereinafter, referred to as the 'first virtual surface IP1') extending an inclined surface of the second region 115*b* of the first management device 2*a*, the user's viewing angle that views the front frame 180 connected to the inner upper plate 115 of the first management device 2*a* may be α1.

Meanwhile, when the inner upper plate 115 of the first management device 2*a* does not form the second area 115*b* but consists of only the first region 115*a*, the user's viewing angle that views the front frame 180 connected to the inner upper plate 115 of the first management device 2*a* may be α2. The dotted line illustrated in FIG. 13 may mean a virtual surface extending the first region 115*a*.

Based on the upper end of the front frame 180, α2 may be an angle greater than α1. Accordingly, as the inner upper plate 115 of the first management device 2*a* forms the second region 115*b*, the user's viewing angle that views the accommodation space 101 of the first management device 2*a* may be extended by an angle of α2−α1.

In one embodiment, based on the first direction (X direction), the second region 115*b* of the second management device 2*b* may form a spacing angle δ2 with respect to the horizontal plane.

The inner upper plate 115 of the second management device 2*b* may have a constant thickness in the second region 115*b* based on the first direction (X direction). Accordingly, based on the second management device 2*b*, the bottom surface of the second region 115*b* may form the spacing angle δ2 with respect to the horizontal plane.

The first region 115*a* may be inclined upwards in the first direction (X direction) to become smaller than the inclination angle formed by the second region 115*b*. That is, based on the first direction (X direction), the inclination of the second region 115*b* of the second management device 2*b* may be greater than the inclination of the first region 115*a* of the second management device 2*b*. Accordingly, δ2 may be an angle greater than δ1.

As illustrated in FIG. 13, when the user's gaze coincides with a virtual surface (hereinafter, referred to as a 'second virtual surface IP2') extending the inclined surface of the second management device (2*b*), the user's viewing angle that views the front frame 180 connected to the inner upper plate 115 of the second management device 2*b* may be β1.

Meanwhile, when the inner upper plate 115 of the second management device 2*b* does not form the second region 115*b* but consists of only the first region 115*a*, the user's viewing angle that views the front frame 180 connected to the inner upper plate 115 of the second management device 2*b* may be β2. The dotted line illustrated in FIG. 13 may mean a virtual surface extending the first region 115*a*.

Based on the upper end of the front frame 180, 82 may be an angle greater than β1. Accordingly, as the inner upper plate 115 of the second management device 2*b* forms the second area 115*b*, the user's viewing angle that views the accommodation space 101 of the second management device 2*b* may be extended by an angle of β2−β1.

In one embodiment, based on the first direction (X direction), the second region 115*b* of the first management device 2*a* and the second region 115*b* of the second management device 2*b* may have the same length.

With respect to the first direction (X direction), the second region 115*b* of the second management device 2*b* may have a greater inclination angle than the second region 115*b* of the first management device 2*a*. That is, δ2 may be an angle greater than θ2.

The second management device 2*b* is provided in a position lower than that of the first management device 2*a*. Accordingly, even if the user bends his knee or waist to look at the accommodation space 101 of the second management device 2*b*, the height difference between the user's gaze and the accommodation space 101 may be greater than the height difference between the user's gaze and the accommodation space 101 of the first management device 2*a* when the user's gaze views the accommodation space 101 of the first management device 2*a*.

Based on the first direction (X direction), as the second region 115*b* of the second management device 2*b* has a greater inclination angle with respect to the horizontal plane than the second region 115*b* of the first management device 2*a*, even if the height difference between the user's gaze and the accommodation space 101 of the second management device 2*b* can be sufficiently larger than the height difference between the user's gaze and the accommodation space 101 of the first management device 2*a*, the user's viewing angle that views the accommodation space 101 can be sufficiently expanded.

A length of the second region 115*b* of the second management device 2*b* based on a direction in which the spacing angle δ2 is formed with respect to the first direction (X direction) may be formed longer than a length of the second region 115*b* of the first management device 2*a* based on a direction in which the spacing angle θ2 is formed with respect to the first direction (X direction).

The second region 115*b* of the first management device 2*a* may be parallel to the second direction (Y direction). Accordingly, as shown in FIG. 12, when the main opening 140 is viewed from the front of the shoes care device 1 with respect to the first management device 2*a*, the bottom surface of the second area 115*b* may not form a height in the second direction (Y direction).

The second region 115*b* of the second management device 2*b* may be parallel to the second direction (Y direction). Accordingly, as shown in FIG. 12, when the main opening 140 is viewed from the front of shoes care device 1 with respect to the second management device 2*b*, the bottom surface of the second area 115*b* may not form a height in the second direction (Y direction).

Figure 15A:
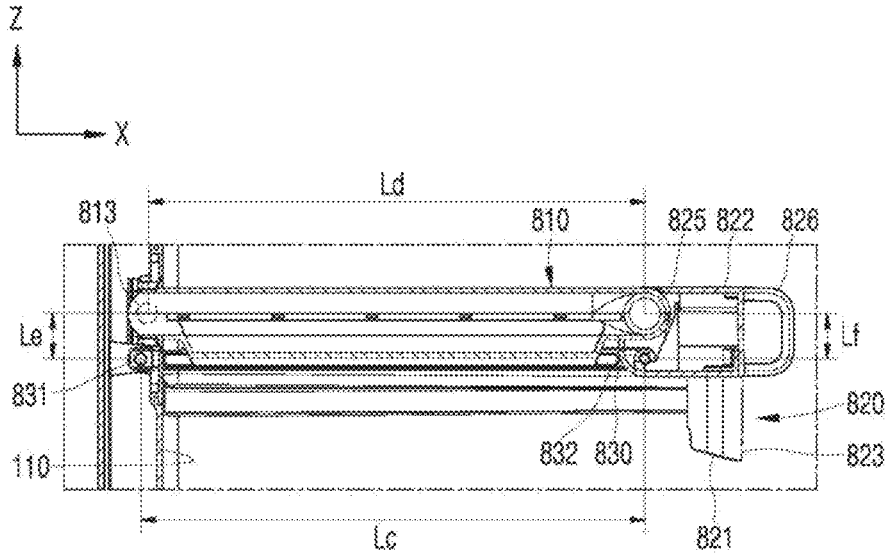
FIG. 15*a* is a view illustrating a state in which an angle of the nozzle duct illustrated in FIG. 13 is adjusted and is a view illustrating a state in which the length direction of the nozzle duct is parallel to the horizontal direction thereof.

FIG. 15*a* is a view illustrating a state in which an angle of the nozzle duct 810 illustrated in FIG. 13 is adjusted and is a view illustrating a state in which the length direction of the nozzle duct 810 is parallel to the horizontal direction thereof.

Figure 15B:
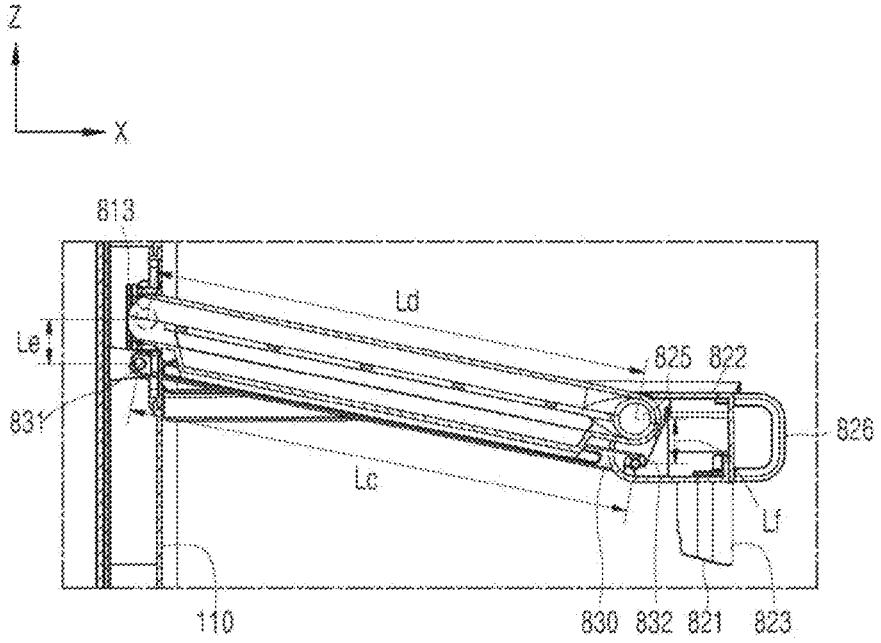
FIG. 15*b* is a view illustrating a state in which the angle of the nozzle duct illustrated in FIG. 13 is adjusted and is a view illustrating a state in which the angle of the nozzle duct is adjusted to descend the nozzle.

FIG. 15*b* is a view illustrating a state in which the angle of the nozzle duct 810 illustrated in FIG. 13 is adjusted and is a view illustrating a state in which the angle of the nozzle duct 810 is adjusted to descend the nozzle 820.

The nozzle duct 810 may form a passage for forcibly ventilated air. The nozzle duct 810 may be installed to protrude forward from the inner rear plate 110. That is, the nozzle duct 810 may be installed to protrude from the inner rear plate 110 into the inner cabinet 100.

One end of the nozzle duct 810 may be hinge-coupled to the inner rear plate 110. One end of the nozzle duct 810 may be hinge-coupled to the inner rear plate 110 through the nozzle duct hinge axis 813. One end of the nozzle duct 810 may rotate around the nozzle duct hinge axis 813.

The nozzle 820 may be coupled to the other end of the nozzle duct 810. Accordingly, the nozzle duct 810 may form a passage through which the forcibly ventilated air is moved to the nozzle 820.

The nozzle 820 is configured to inject air into the shoes.

When an angle of the nozzle duct 810 is adjusted, at least a part of the nozzle 820 may be inserted into the inner side of the shoes. The air injected by the nozzle 820 may be injected inside the shoes in the accommodation space 101. The nozzle 820 may be hinge-coupled to the other end of the nozzle duct 810.

The nozzle 820 may be hinge-coupled to the other end of the nozzle duct 810. The nozzle 820 may include the nozzle body 822 and the nozzle protrusion 823.

The nozzle body 822 may be hinge-coupled to the nozzle duct 810. That is, the nozzle body 822 may be coupled to a nozzle hinge axis 825 formed in the other end of the nozzle duct 810. Accordingly, the nozzle 820 may be rotated around the nozzle hinge axis 825.

The nozzle protrusion 823 may protrude downwards from the nozzle body 822. The nozzle protrusion 823 may have the lower discharge port 821 formed in a lower end thereof. The nozzle 820 may inject air downwards through the lower discharge port 821 while a part of the lower part of the nozzle protrusion 823 is inserted into the shoes.

The nozzle handle 826 may be formed on the nozzle body 822. The nozzle handle 826 may protrude in the first direction (X direction) from the front surface of the nozzle body 822 in the first direction (X direction). The user may adjust the angle of the nozzle duct 810 by holding the nozzle handle 826 and applying force.

The nozzle handle 826 may ascend vertically on the reference plane RP. Based on the second direction (Y direction), the nozzle handle 826 may ascend vertically from the center of the accommodation space 101.

One end of the nozzle connector 830 may be hinge-coupled to the inner rear plate 110. A first connection hinge axis 831 may be formed in one end of the nozzle connector 830. The first connection hinge axis 831 may be rotatably coupled to the inner rear plate 110. Accordingly, the nozzle connector 830 may rotate around the first connection hinge axis 831.

The other end of the nozzle connector 830 may be hinge-coupled to the nozzle 820. A second connection hinge axis 832 may be formed in the other end of the nozzle connector 830. The second connection hinge axis 832 may be rotatably coupled to the nozzle body 822. Accordingly, the nozzle connector 830 may rotate around the second connection hinge axis 832.

The nozzle duct hinge axis 813 and the first connection hinge axis 831 may be rotatably coupled to the inner rear plate 110. Accordingly, the nozzle duct hinge axis 813 and the first connection hinge axis 831 may be rotatably fixed to a specific position of the inner rear plate 110.

That is, positions of the nozzle duct hinge axis 813 and the first connection hinge axis 831 may not be changed with respect to the inner cabinet 100.

The nozzle hinge axis 825 and the second connection hinge axis 832 may be rotatably coupled to the nozzle body 822. Accordingly, the nozzle hinge axis 825 and the second connection hinge axis 832 may be rotatably fixed to a specific position of the nozzle body 822.

That is, positions of the nozzle hinge axis 825 and the second connection hinge axis 832 may not be changed based on the nozzle body 822. However, when the nozzle duct 810 rotates based on the inner cabinet 100, the positions of the nozzle hinge axis 825 and the second connection hinge axis 832 may be changed.

In one embodiment, a distance Ld between the nozzle duct hinge axis 813 and the first connection hinge axis 831 and may be the same as a distance Le between the nozzle hinge axis 825 and the second connection hinge axis 832. In addition, the distance Le between the nozzle duct hinge axis 813 and the nozzle hinge axis 825 may be the same as the distance Lf between the first connection hinge axis 831 and the second connection hinge axis 832.

Accordingly, the nozzle duct hinge axis 813, the nozzle hinge axis 825, the first connection hinge axis 831 and the second connection hinge axis 832 may form each vertex shape of a parallelogram in which two pairs of sides are parallel to each other.

Accordingly, even if the nozzle duct 810 rotates with respect to the inner cabinet 100, the nozzle duct 810 and the nozzle connector 830 may remain parallel to each other. In addition, even if the nozzle duct 810 rotates with respect to the inner cabinet 100, the nozzle body 822 may maintain an angle.

Therefore, even if the nozzle duct 810 rotates with respect to the inner cabinet 100, the nozzle 820 may inject air in a predetermined direction, that is, in a downward direction.

In addition, even if the nozzle duct 810 rotates with respect to the inner cabinet 100, the nozzle handle 826 may maintain a constant angle. Accordingly, even if the nozzle duct 810 rotates, a hand though which the nozzle handle 826 is held may maintain a constant angle. Accordingly, manipulability of the nozzle handle 826 may be improved.

As shown in FIG. 13, the user may hold the nozzle handle 826 and rotate the nozzle duct 810 so that the nozzle 820 ascends. The user may rotate the nozzle duct 810 to bring the upper surface of the nozzle body 822 into contact with the bottom surface of the inner upper plate 115.

Based on a state in which the upper surface of the nozzle body 822 is in contact with the lower surface of the inner upper plate 115 by adjusting the angle of the nozzle duct 810, the first region 115*a* and the nozzle 820 may form an attractive force by magnetic force.

That is, one of the first region 115*a* and the nozzle body 822 may include a first magnetic body M1. Further, the other one of the first region 115*a* and the nozzle body 822 may include a second magnetic body M2. The first magnetic body M1 and the second magnetic body M2 may form the attractive force by magnetic force.

In one embodiment, the first magnetic body M1 and the second magnetic body M2 may be formed of permanent magnets. Alternatively, one of the first and second magnetic bodies M1 and M2 may be made of a permanent magnet, and the other of the first and second magnetic bodies M1 and M2 may be made of a ferromagnetic material.

In one embodiment, the first region 115*a* may include the first magnetic body M1. Further, the nozzle body 822 may include the second magnetic body M2.

When the shoes are not treated, the upper surface of the nozzle body 822 may be brought into contact with the lower surface of the inner upper plate 115 by magnetic force between the first magnetic body M1 and the second magnetic body M2.

As described above, even if the nozzle duct 810 rotates with respect to the inner cabinet 100, the nozzle handle 826 may maintain a constant angle. Accordingly, whenever the upper surface of the nozzle body 822 comes into contact with the lower surface of the inner upper plate 115, the first magnetic body M1 and the second magnetic body M2 may form a constant manpower all the time.

The upper surface of the nozzle body 822 may be formed to correspond to the lower surface of the first region 115*a*. Accordingly, while the upper surface of the nozzle body 822 is brought into contact with the lower surface of the inner upper plate 115, the upper surface of the nozzle body 822 may be in close contact with the lower surface of the inner upper plate 115.

Therefore, when the shoes are not processed, it is possible to suppress the movement of the nozzle body 822 due to external impact and gravity, as well as the occurrence of failures and noise accordingly.

When the shoes are treated, the user may hold the nozzle handle 826 and rotate the nozzle duct 810 so that the nozzle 820 descends. The user may rotate the nozzle duct 810 to insert at least a part of the nozzle protrusion 823 into the shoes.

Based on the state in which the upper surface of the nozzle 820 is in contact with the lower surface of the inner upper plate 115, the nozzle 820 may be disposed in a lower part of the first region 115*a*, and the nozzle handle 826 may be disposed in a lower part of the second region 115*b*.

In one embodiment, the front surface of the nozzle body (822) may be located directly below the boundary between the first region 115*a* and the second region 115*b* with respect to the first direction (X direction).

Accordingly, at least a part of the nozzle handle 826 may be located in front of the first direction (X direction) based on the virtual surfaces extending the inclined surface of the second region 115*b*, that is, the first virtual surface IP1 and the second virtual surface IP2.

Accordingly, when the user's gaze coincides with or is lower than the first and second virtual surfaces IP1 and IP2, some or all of the nozzle handles 826 may be exposed to the user's viewing angle. Accordingly, the user may immediately check the position of the nozzle handle 826 to grip the nozzle handle 826 and rotate the nozzle duct 810.

As shown in FIG. 13, the first virtual surface IP1 and the second virtual surface IP2 may be positioned above the shoes. In addition, when treating the shoes, the user may hold the nozzle handle 826 and rotate the nozzle duct 810 so that the nozzle 820 descends.

Accordingly, based on a state in which the nozzle handle 826 is moved by adjusting the angle of the nozzle duct 810, at least a part or all of the nozzle handle 826 may move in front of the first direction (X direction) based on the virtual surfaces extending the inclined surface of the second area 115*b*, that is, the first virtual surface IP1 and the second virtual surface IP2.

Accordingly, based on a state in which the nozzle handle 826 is moved by adjusting the angle of the nozzle duct 810, part or all of the nozzle handle 826 may be exposed to the user" viewing angle. Accordingly, the user may grip the nozzle handle 826 and rotate the nozzle duct 810 while visually checking the position of the nozzle handle 826.

Figure 16:
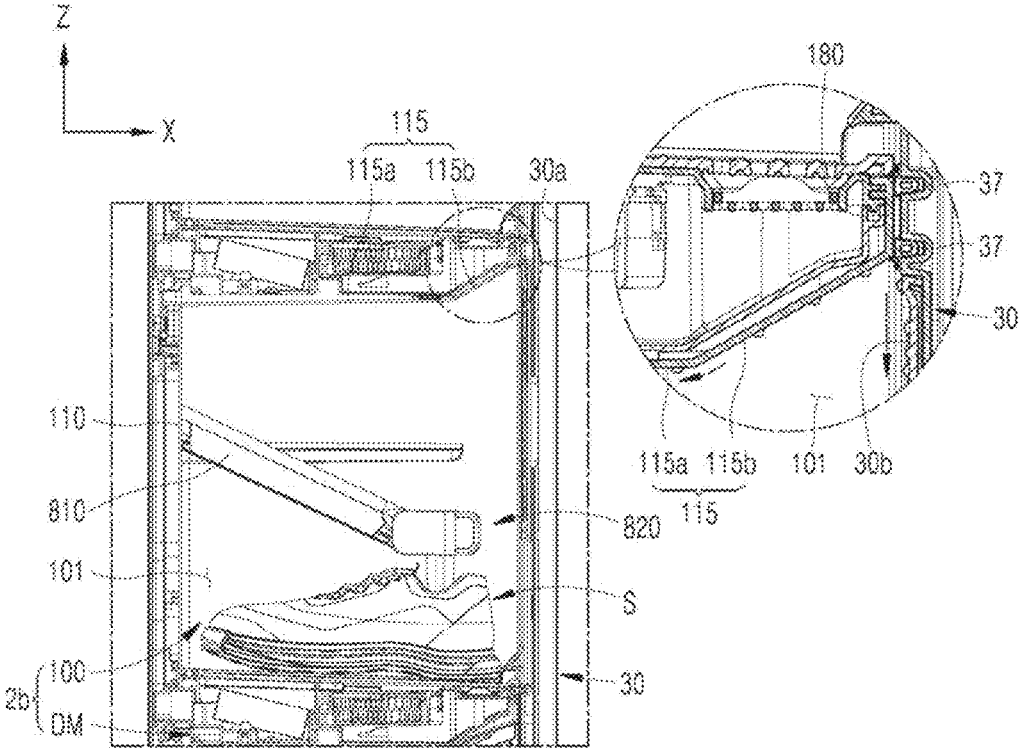
FIG. 16 is a cross-sectional view illustrating a state in which the door is removed from the shoes care device illustrated in FIG. 4*c*.

FIG. 16 is a cross-sectional view illustrating a state in which the door 30 is removed from the shoes care device 1 illustrated in FIG. 4*c*. FIG. 16 illustrates the inside of the inner cabinet 100 of the second management device 2*b*.

The door 30 is configured to open and close the inside of the shoes care device 1. That is, the door 30 may be configured to open and close the main opening 140. In one embodiment, the shoes care device 1 may include one door 30.

The door 30 may form one surface of the shoes care device 1. In one embodiment, the door 30 may form a front surface of the shoes care device 1 based on the first direction (X direction). In shoes care device 1, the door 30 may be hinge-coupled.

The door 30 may include a front plate 30*a* and a rear plate 30*b*. The front plate 30*a* may form the front surface of the shoes care device 1 in a state where the door 30 closes the accommodation space 101. The rear plate 30*b* may form a surface for closing the accommodation space 101 in a state where the door 30 closes the accommodation space 101.

A packing 37 may be coupled to the rear plate 30*b*. With the door 30 closing the accommodation space 101, the packing 37 may be compressed between the rear plate 30*b* and the front surface of the inner cabinet 100 along the circumference of the main opening 140. The packing 37 may remove a gap between the front surface and rear plate 30*b* of the inner cabinet 100.

When using the shoes care device 1, frostiness in which air containing water vapor becomes water droplets and is attached to the wall may occur on the inner surface of the inner cabinet 100 and on the rear plate 30*b*.

As described above, the second region 115*b* of the first management device 2*a* may form the spacing angle θ2 with respect to the horizontal plane. The second region 115*b* of the second management device 2*b* may form the spacing angle δ2 with respect to the horizontal plane. Accordingly, moisture formed in the second region 115*b* may move to the boundary of the first region 115*a* along the inclined surface of the second region 115*b*.

Accordingly, moisture generated in the inner cabinet 100 may not move to the rear plate 30*b*. Accordingly, the amount of moisture formed on the rear plate 30*b* may be suppressed.

As described above, the first region 115*a* of the first management device 2*a* may form the spacing angle θ1 with respect to the horizontal plane. The first region 115*a* of the second management device 2*b* may form the spacing angle δ1 with respect to the horizontal plane.

Accordingly, the moisture moving to the boundary of the first region 115*a* may move to the inner rear plate 110 along the inclined surface of the first region 115*a*. Accordingly, the moisture generated on the inner upper plate 115 may not drop to the shoes. Accordingly, contamination of shoes caused by frostiness may be prevented.

Hereinabove, a specific embodiment of the present invention is described and illustrated, but the present invention is not limited to the disclosed embodiment, and it may be appreciated by those skilled in the art that the exemplary embodiment can be variously modified and transformed to another specific embodiment without departing from the spirit and the scope of the present invention. Therefore, the scope of the present invention will not be defined by the described embodiment, but defined by the technical spirit disclosed in the claims.

INDUSTRIAL APPLICABILITY

With the shoe care apparatus according to the present disclosure, the second region extends in front of the first region with reference to the first direction and provides an upwardly inclined surface, and at least a portion of the nozzle handle located in front of a virtual plane extending from the inclined surface of the second region. As a result, the user's viewing angle looking at the accommodation space is increased, and at least a portion of the nozzle handle is exposed to the user's viewing angle. In view of these points, the present disclosure overcomes the limitations of existing technology. Thus, the present disclosure can be used in related technologies, the possibility of marketing or commercializing devices to which the present disclosure is applied is sufficient, and it is apparent that the present disclosure can be implemented in reality. Therefore, the present disclosure has industrial applicability.

What is claimed is:

1. A shoe care apparatus comprising:

an inner cabinet having an accommodation space configured to accommodate shoes therein, the inner cabinet having:

a main opening; and an inner upper plate defining a ceiling of the accommodation space, the inner upper plate having:

a first region; and a second region extending in front of the first region, the second region having an upwardly inclined surface;

a door configured to open and close the main opening;

a nozzle duct defining a passage for air, the nozzle duct having a first end connected to the inner cabinet by a hinge and a second end spaced from the first end;

a nozzle having a first end connected to the second end of the nozzle duct, the nozzle being configured to be insertable into the shoes, the nozzle having a lower discharge port configured to spray air into the shoes; and a nozzle handle provided on the nozzle to adjust an angle of the nozzle duct, at least a portion of the nozzle handle being located in front of a virtual plane extending from and parallel to the inclined surface of the second region.

2. The shoe care apparatus of claim 1, wherein the nozzle is located below the first region, and wherein, when the nozzle contacts a lower surface of the inner plate, the nozzle handle is located below the second region of the inner plate.

3. The shoe care apparatus of claim 2, wherein at least one of the first region and the nozzle is magnetic.

4. The shoe care apparatus of claim 3, wherein one of the first region and the nozzle includes a first magnetic body, and wherein a remaining one of the first region and the nozzle includes a second magnetic body configured to provide a magnetic force with the first magnetic body.

5. The shoe care apparatus of claim 1, wherein, when the nozzle is brought into contact with the first region, all of the nozzle handle is located in front of the virtual plane.

6. The shoe care apparatus of claim 1, wherein the inner cabinet comprises a front frame, the front frame defining an edge of the main opening, the front frame extending in front of the inner upper plate such that a front surface of the front frame is normal to the first region.

7. The shoe care apparatus of claim 1, wherein the inner cabinet is provided in plurality to define a first management device and a second management device located below the first management device, and wherein an inclination angle of the second region of the second management device relative to a horizonal plane is larger than an inclination angle of the second region of the first management device relative to the horizontal plane.

8. The shoe care apparatus of claim 7, wherein each of the inner cabinets comprises a front frame defining an edge of the main opening, and wherein the front frame of the inner cabinet of the first management device and the front frame of the inner cabinet of the second management device are connected to each other.

9. The shoe care apparatus of claim 1, wherein the first region is inclined upward from a rear of the cabinet at a smaller angle relative to a horizontal plane than an inclination angle of the second region relative to the horizontal plane.

10. The shoe care apparatus of claim 1, wherein the inner cabinet further includes an inner rear plate defining a rear wall surface of the accommodation space, and wherein the nozzle duct protrudes forward from the inner rear plate.

11. The shoe care apparatus of claim 1, wherein the nozzle is connected to the nozzle duct by a hinge.

12. The shoe care apparatus of claim 11, further comprising a nozzle connector having a first end connected to the inner cabinet by a hinge and a second end connected to the nozzle by a hinge.

13. The shoe care apparatus of claim 12, wherein a length of the nozzle connector corresponds to a length of the nozzle duct such that an orientation of the nozzle is maintained while moving up and down.

14. The shoe care apparatus of claim 12, wherein the nozzle duct has a nozzle groove extending in a longitudinal direction of the nozzle duct, and wherein the nozzle connector is located in the nozzle groove.

15. The shoe care apparatus of claim 1, wherein the nozzle comprises:

a nozzle body, the nozzle body being connected to the nozzle duct; and a nozzle protrusion protruding downward from the nozzle body, the lower discharge port being provided at an end of the nozzle protrusion.

16. The shoe care apparatus of claim 15, wherein an upper surface of the nozzle body is configured to correspond to a lower surface of the first region.

17. The shoe care apparatus of claim 15, wherein the nozzle duct includes an upper discharge port, the upper discharge port facing upward, and wherein the nozzle body includes an auxiliary discharge port at an upper surface of the nozzle body.

18. The shoe care apparatus of claim 1, further comprising:

a suction port configured to suck air from inside the inner cabinet;

a connection flow path from the suction port to the nozzle; and a blower located in the connection flow path, the blower being configured to move air from the suction port toward the nozzle.

19. The shoe care apparatus of claim 18, further comprising a dehumidifier located in the connection flow path, the dehumidifier being configured to dehumidify the air in the connection flow path.

20. The shoe care apparatus of claim 19, further comprising a steam generator configured to supply steam to the inner cabinet.

* * * * *